US008648892B2

(12) United States Patent
Suzuki et al.

(10) Patent No.: US 8,648,892 B2
(45) Date of Patent: Feb. 11, 2014

(54) IMAGE FORMING APPARATUS TO DETECT AND CORRECT DENSITY VARIATIONS IN A DEVELOPED IMAGE

(75) Inventors: Seizo Suzuki, Chiba (JP); Masaaki Ishida, Kanagawa (JP); Atsufumi Omori, Kanagawa (JP); Kazuhiro Akatsu, Kanagawa (JP); Muneaki Iwata, Kanagawa (JP); Hayato Fujita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 84 days.

(21) Appl. No.: 13/354,789

(22) Filed: Jan. 20, 2012

(65) Prior Publication Data

US 2012/0189328 A1 Jul. 26, 2012

(30) Foreign Application Priority Data

Jan. 25, 2011 (JP) ..... 2011-012480

(51) Int. Cl.
*B41J 2/435* (2006.01)
*G03G 15/04* (2006.01)

(52) U.S. Cl.
USPC ..... 347/236; 399/32

(58) Field of Classification Search
USPC ..... 347/236; 399/32, 301, 51; 358/475
See application file for complete search history.

(56) References Cited

U.S. PATENT DOCUMENTS

| | | | | |
|---|---|---|---|---|
| 5,355,244 | A | 10/1994 | Suzuki et al. | |
| 5,459,601 | A | 10/1995 | Suzuki et al. | |
| 6,498,617 | B1 | 12/2002 | Ishida et al. | |
| 6,731,317 | B2 | 5/2004 | Ema et al. | |
| 6,791,596 | B2 | 9/2004 | Nihei et al. | |
| 7,496,121 | B2 | 2/2009 | Ishida et al. | |
| 7,903,133 | B2 | 3/2011 | Suzuki et al. | |
| 7,936,367 | B2 | 5/2011 | Ishida et al. | |
| 2008/0144132 | A1* | 6/2008 | Koga | 358/475 |
| 2008/0291259 | A1 | 11/2008 | Nihei et al. | |
| 2008/0292369 | A1* | 11/2008 | Takezawa | 399/301 |
| 2009/0074437 | A1 | 3/2009 | Tanabe et al. | |
| 2009/0174915 | A1 | 7/2009 | Nihei et al. | |
| 2009/0175657 | A1 | 7/2009 | Yoshii et al. | |
| 2009/0195635 | A1 | 8/2009 | Ishida et al. | |
| 2009/0231656 | A1 | 9/2009 | Suzuki et al. | |
| 2009/0238591 | A1* | 9/2009 | Watanabe et al. | 399/51 |
| 2010/0214637 | A1 | 8/2010 | Nihei et al. | |
| 2011/0199657 | A1 | 8/2011 | Ishida et al. | |

FOREIGN PATENT DOCUMENTS

| | | |
|---|---|---|
| JP | 2007-135100 | 5/2007 |
| JP | 2008-65270 | 3/2008 |
| JP | 2009-262344 | 11/2009 |

* cited by examiner

*Primary Examiner* — Stephen Meier
*Assistant Examiner* — Carlos A Martinez
(74) *Attorney, Agent, or Firm* — Oblon, Spivak, McClelland, Maier & Neustadt, L.L.P.

(57) ABSTRACT

Apparatus that forms an image according to image information includes density sensors that detect image density variations in main and sub-scanning directions. A processing device generates correction data for correcting a light source output to suppress the density variations based on detection results. The processing device modifies the correction data such that the light source output after the correction is at least a minimum rated output at a position at which the output after the correction is lower than the minimum rated output, in the relation between a position on the surface of the photosensitive element in the main-scanning direction and the output after the correction, and modifies the correction data such that the light source output after the correction is at most a maximum rated output at a position at which the output after the correction is higher than the maximum rated output.

5 Claims, 29 Drawing Sheets

IMAGE FORMING APPARATUS TO DETECT AND CORRECT DENSITY VARIATIONS IN A DEVELOPED IMAGE

CROSS-REFERENCE TO RELATED APPLICATIONS

The present application claims priority to and incorporates by reference the entire contents of Japanese Patent Application No. 2011-012480 filed in Japan on Jan. 25, 2011.

BACKGROUND OF THE INVENTION

1. Field of the Invention

The present invention relates to an image forming apparatus, and more particularly, to an image forming apparatus which uses laser beams.

2. Description of the Related Art

An image forming apparatus such as a laser printer, a digital copying machine, or a facsimile machine includes: a photosensitive element of which the surface has photosensitivity as a scanning surface; a light source that emits laser beams; a polygon mirror that deflects the laser beams emitted from the light source; a scanning optical system that leads the laser beams deflected by the polygon mirror to a photosensitive element, and the like.

A light spot positioned on the photosensitive element moves in the axial direction of the photosensitive element in accordance with the rotation of the polygon mirror, thereby performing scanning corresponding to one line. Then, when the scanning corresponding to one line is completed, the photosensitive element rotates so as to start the next scanning.

Since the scanning optical system is configured by optical elements such as a lens, a glass plate, and a mirror, the light use efficiency (reflectance or transmittance) differs in accordance with the incidence angle of light. In addition, the thickness of the lens differs in accordance with the incident position of light.

Since the laser beams deflected by the polygon mirror are incident to the scanning optical system with the incidence angle corresponding to a defection angle in the polygon mirror, and the incident position in the scanning optical system differs depending on the irradiation position in the photosensitive element, the intensity of the laser beams on the photosensitive element is not uniform and differs in accordance with the irradiation position.

The variation in the intensity of the laser beams according to an irradiation position is called "shading characteristics" and is one of factors that degrade the image quality by generating a density variation in an image (also referred to as an "output image") output from the image forming apparatus. Thus, various methods for correcting the shading characteristics have been proposed (for example, see Japanese Patent Application Laid-Open Nos. 2007-135100 and 2009-262344).

In addition, an image forming apparatus that controls the amount of exposure in accordance with a variation in the sensitivity of a photosensitive element is disclosed in Japanese Patent Application Laid-Open No. 2008-065270.

In a case where the photosensitive element is eccentric or has a cross-section that is not a perfect circle, when the photosensitive element rotates, a gap between the photosensitive element and a developing roller changes. Such a change in the gap causes a variation in a developing process, whereby an unnecessary density variation occurs in the output image.

Recently, there has been a strong request for improving the image quality, but it is difficult to suppress the density variation in an output image, which is caused by the eccentricity of the photosensitive element or a form error, to the requested level by using the conventional method.

SUMMARY OF THE INVENTION

It is an object of the present invention to at least partially solve the problems in the conventional technology.

According to an aspect of the present invention, there is provided an image forming apparatus that forms an image according to image information, including: a photosensitive element; an optical scanning device that includes a light source, scans a surface of the photosensitive element in a main-scanning direction using light emitted from the light source, and forms a latent image on the surface of the photosensitive element; a developing unit that develops the latent image; a plurality of density sensors that are used for detecting density variations of the image developed by the developing unit in the main-scanning direction and a sub-scanning direction perpendicular to the main-scanning direction; and a processing device that generates correction data used for correcting an output of the light source so as to suppress the density variations based on detection results of the plurality of density sensors, modifies the correction data such that the output after the correction is at a minimum rated output or more at a position at which the output after the correction is lower than the minimum rated output of the light source, in the relation between a position on the surface of the photosensitive element in the main-scanning direction and the output of the light source after the correction, and modifies the correction data such that the output after the correction is at a maximum rated output or less at a position at which the output after the correction is higher than the maximum rated output of the light source.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
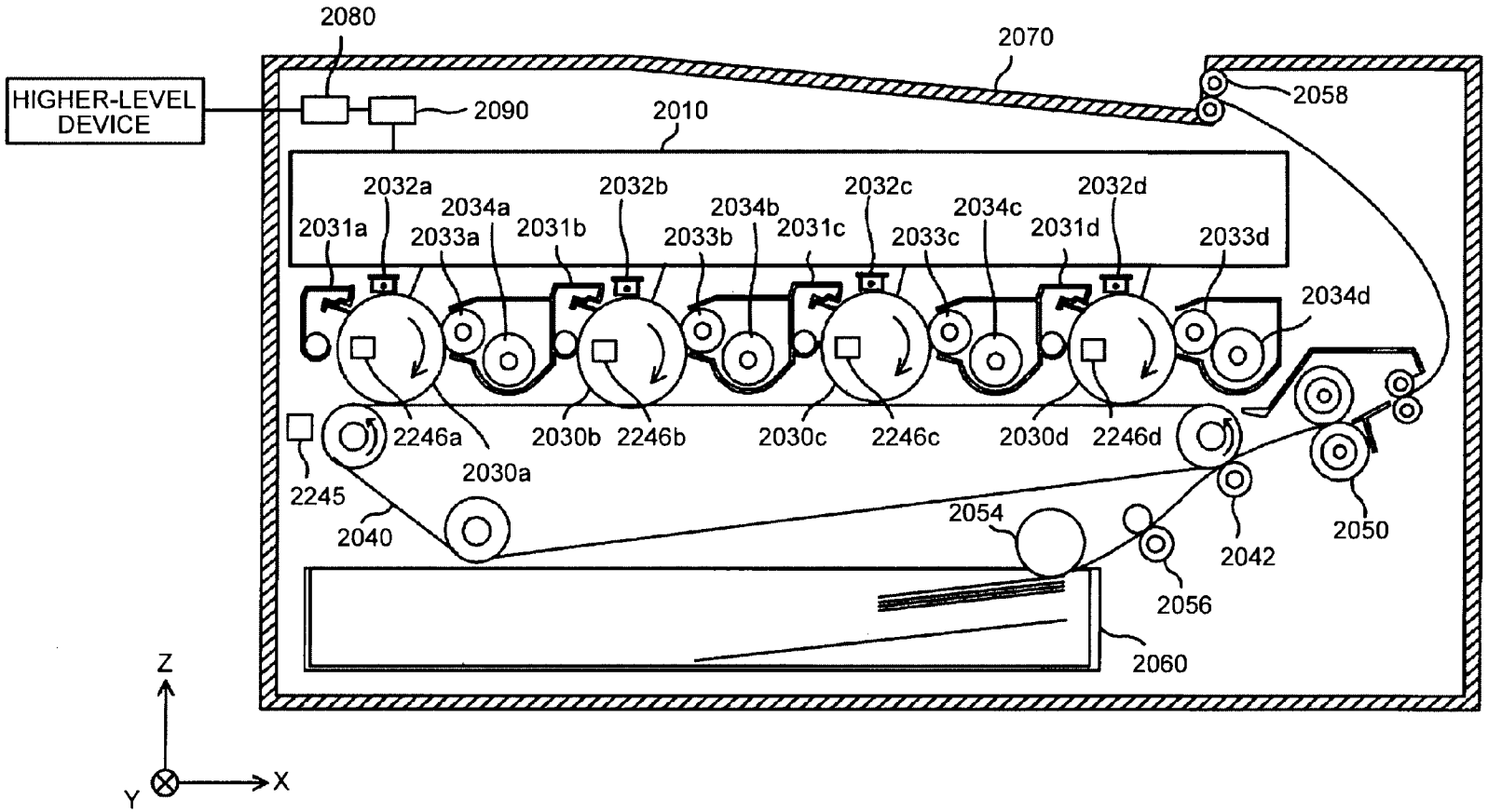
FIG. 1 is a diagram illustrating a schematic configuration of a color printer according to an embodiment of the invention.

Hereinafter, an embodiment of the invention will be described with reference to FIGS. 1 to 40. FIG. 1 illustrates a schematic configuration of a color printer 2000 as an image forming apparatus according to an embodiment.

The color printer 2000 is a multi-color color printer employing a tandem system that forms a full-color image by superimposing four colors (black, cyan, magenta, and yellow) and includes: an optical scanning device 2010; four photosensitive elements (2030*a*, 2030*b*, 2030*c*, and 2030*d*); four cleaning units (2031*a*, 2031*b*, 2031*c*, and 2031*d*), four charging units (2032*a*, 2032*b*, 2032*c*, and 2032*d*); four developing rollers (2033*a*, 2033*b*, 2033*c*, and 2033*d*); four toner cartridges (2034*a*, 2034*b*, 2034*c*, and 2034*d*); a transfer belt 2040; a transfer roller 2042; a fixing device 2050; a paper feeding roller 2054, a registration roller pair 2056; a discharging roller 2058; a paper feed tray 2060; a discharge tray 2070; a communication control device 2080; a density detector 2245; four home position sensors (2246*a*, 2246*b*, 2246*c*, and 2246*d*); a temperature-humidity sensor (not illustrated in the figure); a printer control device 2090 that performs the overall control of each unit described above; and the like.

The communication control device 2080 controls two-way communication with a higher-level device (for example, a personal computer (PC)) through a network or the like.

The printer control device 2090 includes: a central processing unit (CPU); a read only memory (ROM) in which a program described in a code that can be decoded by the CPU and various kinds of data used for executing the program are stored; a random access memory (RAM) that is a memory for a work; an AD conversion circuit that converts analog data into digital data; and the like. The printer control device 2090 controls each unit in accordance with a request from a higher-level device and transmits image information delivered from the higher-level device to the optical scanning device 2010.

The temperature-humidity sensor detects the temperature and the humidity inside the color printer 2000 and notifies the printer control device 2090 of the detected temperature and humidity.

The photosensitive element 2030*a*, the charging unit 2032*a*, the developing roller 2033*a*, the toner cartridge 2034*a*, and the cleaning unit 2031*a* are used as a set and configure an image forming station (hereinafter, for convenience of the description, also referred to as a "K station") that forms a black image.

The photosensitive element 2030*b*, the charging unit 2032*b*, the developing roller 2033*b*, the toner cartridge 2034*b*, and the cleaning unit 2031*b* are used as a set and configure an image forming station (hereinafter, for convenience of the description, also referred to as a "C station") that forms a cyan image.

The photosensitive element 2030*c*, the charging unit 2032*c*, the developing roller 2033*c*, the toner cartridge 2034*c*, and the cleaning unit 2031*c* are used as a set and configure an image forming station (hereinafter, for convenience of the description, also referred to as an "M station") that forms a magenta image.

The photosensitive element 2030*d*, the charging unit 2032*d*, the developing roller 2033*d*, the toner cartridge 2034*d*, and the cleaning unit 2031*d* are used as a set and configure an image forming station (hereinafter, for convenience of the description, also referred to as a "Y station") that forms a yellow image.

On the surface of each photosensitive element, a photosensitive layer is formed. In other words, the surface of each photosensitive element configures a scanning surface. In addition, it is assumed that each photosensitive element is rotated by a rotating mechanism, which is not illustrated in the figure, in the direction of the arrow within the plane illustrated in FIG. 1.

Here, in the three-dimensional orthogonal coordinate system of XYZ, a direction extending along the longitudinal direction of each photosensitive element is described as the Y axis direction, and the direction extending along the arrangement direction of the four photosensitive elements is described as the X axis direction.

Each charging unit uniformly charges the surface of the photosensitive element corresponding thereto.

The optical scanning device 2010 emits a light beam modulated for each color onto the surface of the charged photosensitive element corresponding to the color based on multicolor image information (black image information, cyan image information, magenta image information, and yellow image information) transmitted from a higher-level device. Accordingly, on the surface of each photosensitive element, electric charges disappear in a portion onto which the light is emitted, whereby a latent image corresponding to the image information is formed on the surface of each photosensitive element. The latent image formed here is moved in the direction of the corresponding developing roller in accordance with the rotation of the photosensitive element. The configuration of the optical scanning device 2010 will be described later.

In each photosensitive element, an area in which the image information is written is called an "effective scanning area", an "image forming area", an "effective image area", or the like.

In the toner cartridge 2034*a*, black toner is stored, and the toner is supplied to the developing roller 2033*a*. In addition, in the toner cartridge 2034*b*, cyan toner is stored, and the toner is supplied to the developing roller 2033*b*. In the toner cartridge 2034*c*, magenta toner is stored, and the toner is supplied to the developing roller 2033*c*. Furthermore, in the toner cartridge 2034*d*, yellow toner is stored, and the toner is supplied to the developing roller 2033*d*.

The surface of each developing roller is thinly and uniformly coated with toner supplied from the corresponding toner cartridge in accordance with the rotation of the developing roller. Then, when the toner disposed on the surface of each developing roller is brought into contact with the surface of the corresponding photosensitive element, the toner is transferred only to a portion of the surface onto which the light is emitted and attached thereto. In other words, each developing roller attaches toner to the latent image formed on the surface of the photosensitive element corresponding thereto so as to be developed. Here, an image (toner image) acquired by attaching the toner is moved in the direction of the transfer belt 2040 in accordance with the rotation of the photosensitive element.

The toner images of yellow, magenta, cyan, and black are sequentially transferred onto the transfer belt 2040 at predetermined operational timing and are superimposed so as to form a color image. The moving direction of the toner image on the transfer belt 2040 is called a "sub direction", and a direction perpendicular to the sub direction is called a "main direction".

In the paper feed tray 2060, recording sheets are stored. Near the paper feed tray 2060, the paper feeding roller 2054 is arranged, and the paper feeding roller 2054 takes out the recording sheets from the paper feed tray 2060 one at a time and conveys the recording sheet to the registration roller pair 2056. The registration roller pair 2056 sends a recoding sheet toward a gap between the transfer belt 2040 and the transfer roller 2042 at predetermined operational timing. Accordingly, the color image formed on the transfer belt 2040 is transferred to the recording sheet. Here, the transferred recording sheet is sent to the fixing device 2050.

In the fixing device 2050, heat and pressure are applied to the recording sheet, whereby the toner is fixed on the recording sheet. The recording sheet fixed here is sent to the discharge tray 2070 through the discharging roller 2058, and the fixed recording sheets are sequentially piled up on the discharge tray 2070.

Each cleaning unit removes the toner (residual toner) that remains on the surface of the photosensitive element corresponding thereto. The surface of the photosensitive element from which the residual toner is removed is returned to a position facing the charging unit corresponding thereto.

Figure 2:
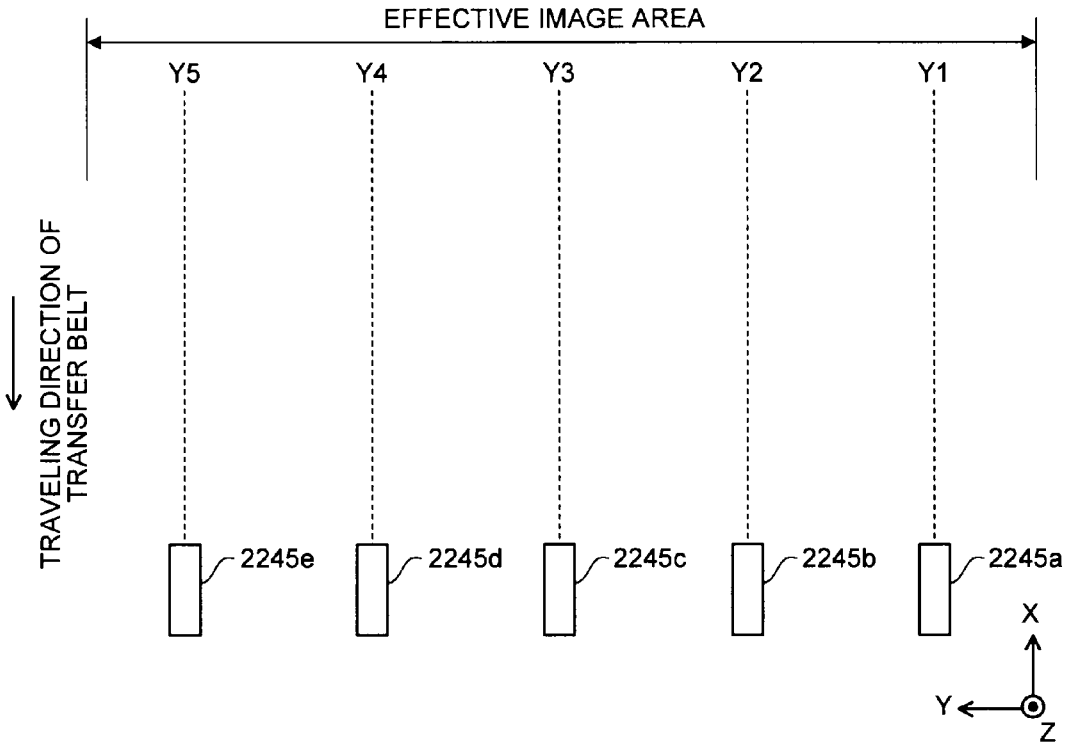
FIG. 2 is a diagram illustrating a density detector shown in FIG. 1.

The density detector 2245 is arranged on the −X side of the transfer belt 2040. This density detector 2245, for example, as illustrated in FIG. 2, includes five optical sensors (2245*a*, 2245*b*, 2245*c*, 2245*d*, and 2245*e*).

The optical sensor 2245*a* is arranged at a position that faces an area located near the end portion of the transfer belt 2040 on the −Y side within the effective image area, the optical sensor 2245*e* is arranged at a position that faces an area located near the end portion of the transfer belt 2040 on the +Y side within the effective image area, and the optical sensors 2245*b* to 2245*d* are arranged at almost equal intervals between the optical sensor 2245*a* and the optical sensor 2245*e* in the Y axis direction. Here, in the Y axis direction, it is assumed that the center position of the optical sensor 2245*a* is Y1, the center position of the optical sensor 2245*b* is Y2, the center position of the optical sensor 2245*c* is Y3, the center position of the optical sensor 2245*d* is Y4, and the center position of the optical sensor 2245*e* is Y5.

Figure 3:
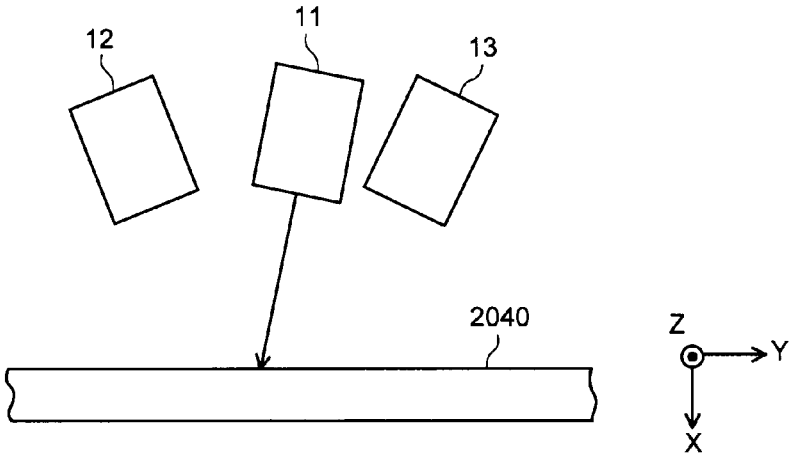
FIG. 3 is a diagram illustrating the configuration of each optical sensor.
Figure 4:
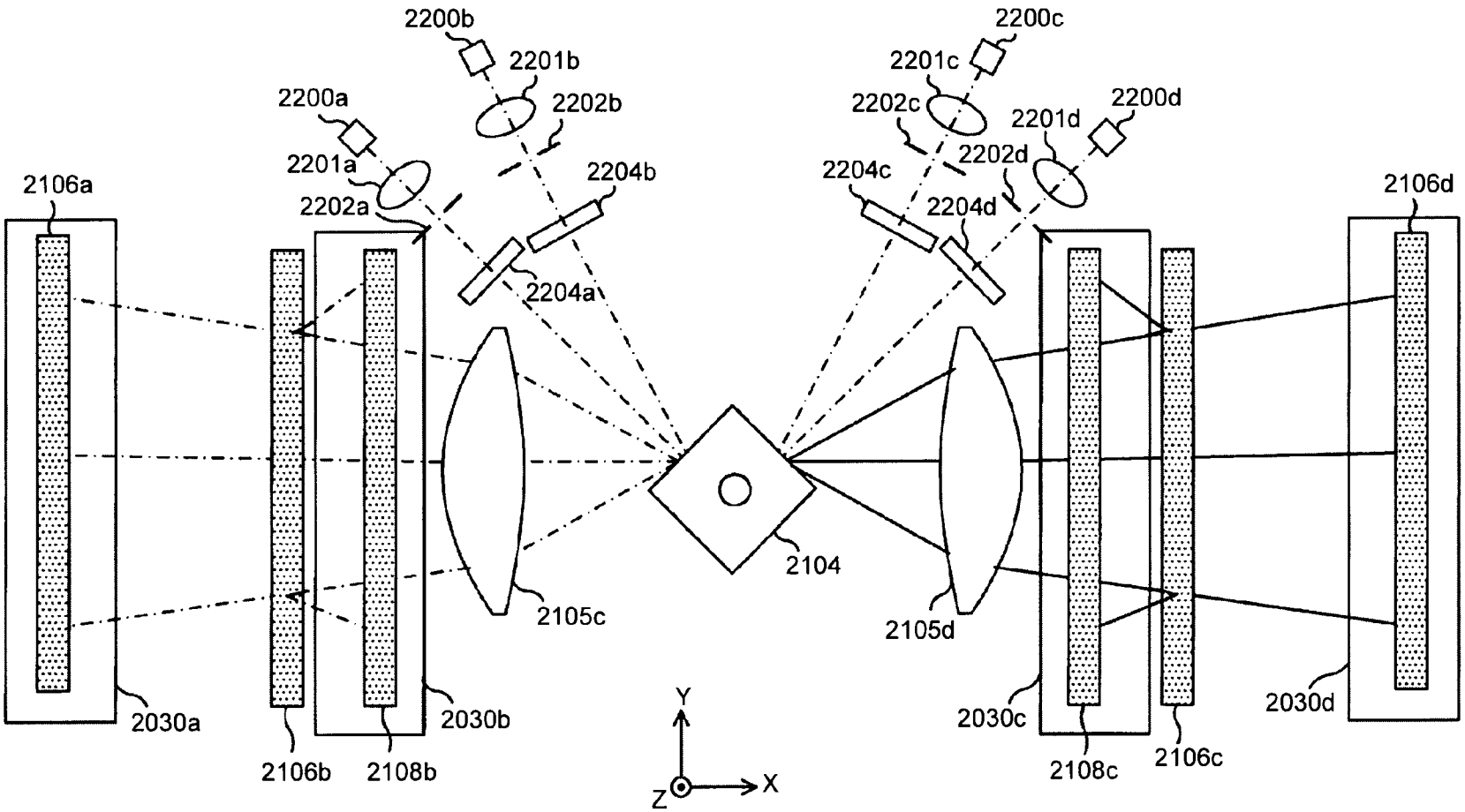
FIG. 4 is a diagram (1) illustrating an optical scanning device shown in FIG. 1.
Figure 5:
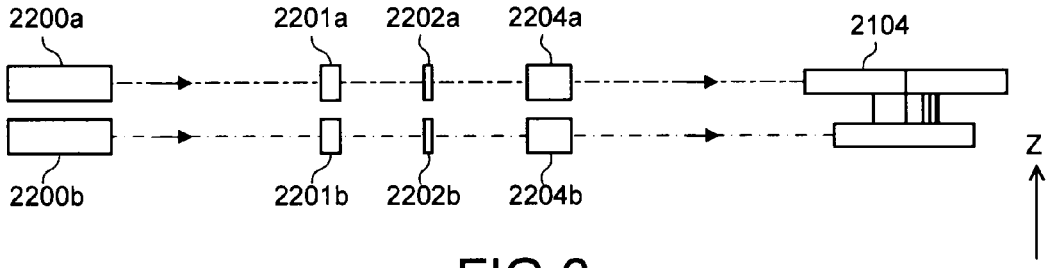
FIG. 5 is a diagram (2) illustrating the optical scanning device shown in FIG. 1.
Figure 6:
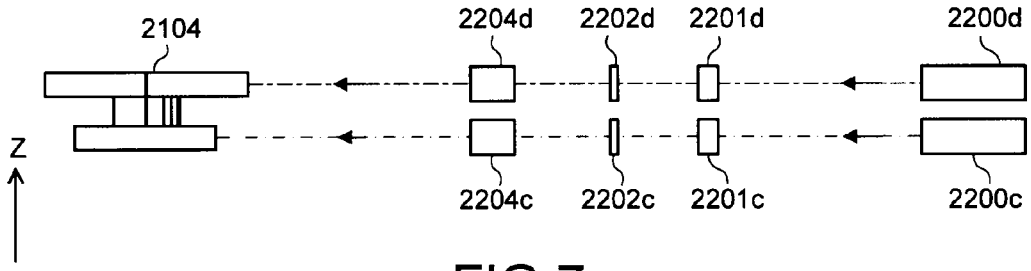
FIG. 6 is a diagram (3) illustrating the optical scanning device shown in FIG. 1.
Figure 7:
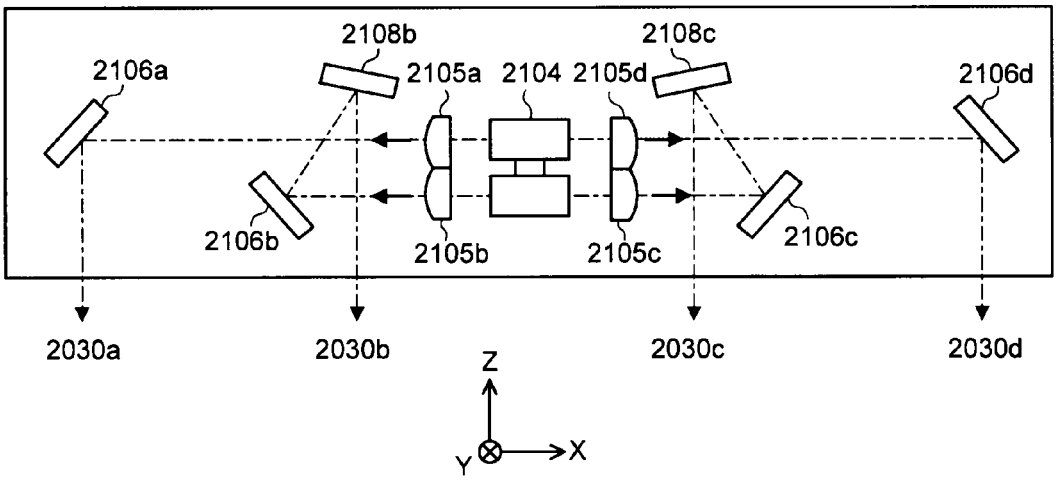
FIG. 7 is a diagram (4) illustrating the optical scanning device shown in FIG. 1.

Each optical sensor, for example, as shown in FIG. 3, includes: a light emitting diode (LED) 11 that emits light (hereinafter, also referred to as "detection light") toward the transfer belt 2040; a regular-reflection light receiving element 12 that receives regular-reflection light from the transfer belt 2040 or the toner image formed on the transfer belt 2040; and a diffuse-reflection light receiving element 13 that receives diffuse-reflection light from the transfer belt 2040 or the toner image formed on the transfer belt 2040. Each light receiving element outputs a signal (photoelectric conversion signal) according to the amount of received light.

A home position sensor 2246*a* detects the home position of the rotation of the photosensitive element 2030*a*.

A home position sensor 2246*b* detects the home position of the rotation of the photosensitive element 2030*b*.

A home position sensor 2246*c* detects the home position of the rotation of the photosensitive element 2030*c*.

A home position sensor 2246*d* detects the home position of the rotation of the photosensitive element 2030*d*.

Next, the configuration of the optical scanning device 2010 will be described.

The optical scanning device 2010, for example, as shown in FIGS. 4 to 7, includes: four light sources (2200*a*, 2200*b*, 2200*c*, and 2200*d*); four coupling lenses (2201*a*, 2201*b*, 2201*c*, and 2201*d*); four opening plates (2202*a*, 2202*b*, 2202*c*, and 2202*d*); four cylindrical lenses (2204*a*, 2204*b*, 2204*c*, and 2204*d*); a polygon mirror 2104; four scanning lenses (2105*a*, 2105*b*, 2105*c*, and 2105*d*), six folding mirrors (2106*a*, 2106*b*, 2106*c*, 2106*d*, 2108*b*, and 2108*c*), a scanning control device 3022 (not illustrated in FIGS. 4 to 7; see FIG. 8); and the like. These can be assembled at predetermined positions in an optical housing (not illustrated in the figure).

Each light source includes a surface-emitting laser array of the vertical cavity type in which a plurality of light emitting elements is two-dimensionally arranged. The plurality of light emitting elements of the surface-emitting laser array are arranged such that light emitting element gaps are the same when all the light emitting elements are orthographically projected onto a virtual line growing in the direction corresponding to sub-scanning. In description here, the "light emitting element gap" represents a distance between the centers of two light emitting elements.

The coupling lens 2201*a* is arranged on the optical path of the light beam emitted from the light source 2200*a* and makes the light beam an approximately parallel light beam.

The coupling lens 2201*b* is arranged on the optical path of the light beam emitted from the light source 2200*b* and makes the light beam an approximately parallel light beam.

The coupling lens 2201*c* is arranged on the optical path of the light beam emitted from the light source 2200*c* and makes the light beam an approximately parallel light beam.

The coupling lens 2201*d* is arranged on the optical path of the light beam emitted from the light source 2200*d* and makes the light beam an approximately parallel light beam.

The opening plate 2202*a* includes an opening portion and shapes the light beam passing through the coupling lens 2201*a*.

The opening plate 2202*b* includes an opening portion and shapes the light beam passing through the coupling lens 2201*b*.

The opening plate 2202*c* includes an opening portion and shapes the light beam passing through the coupling lens 2201*c*.

The opening plate 2202*d* includes an opening portion and shapes the light beam passing through the coupling lens 2201*d*.

The cylindrical lens 2204*a* forms an image by using the light beam passing through the opening portion of the opening plate 2202*a* near a deflected reflecting surface of the polygon mirror 2104 in the Z axis direction.

The cylindrical lens 2204*b* forms an image by using the light beam passing through the opening portion of the opening plate 2202*b* near a deflected reflecting surface of the polygon mirror 2104 in the Z axis direction.

The cylindrical lens 2204*c* forms an image by using the light beam passing through the opening portion of the opening plate 2202*c* near a deflected reflecting surface of the polygon mirror 2104 in the Z axis direction.

The cylindrical lens 2204*d* forms an image by using the light beam passing through the opening portion of the opening plate 2202*d* near a deflected reflecting surface of the polygon mirror 2104 in the Z axis direction.

An optical system that is formed by the coupling lens 2201*a*, the opening plate 2202*a*, and the cylindrical lens 2204*a* is a before-deflector optical system of the K station.

An optical system that is formed by the coupling lens 2201*b*, the opening plate 2202*b*, and the cylindrical lens 2204*b* is a before-deflector optical system of the C station.

An optical system that is formed by the coupling lens 2201*c*, the opening plate 2202*c*, and the cylindrical lens 2204*c* is a before-deflector optical system of the M station.

An optical system that is formed by the coupling lens 2201*d*, the opening plate 2202*d*, and the cylindrical lens 2204*d* is a before-deflector optical system of the Y station.

The polygon mirror 2104 includes tetrahedral mirrors, which rotate around an axis parallel to the Z axis, which has a two-stage structure, and each mirror serves as a deflected reflecting surface. The polygon mirror 2104 is arranged such that the light beam passing through the cylindrical lens 2204*b* and the light beam passing through the cylindrical lens 2204*c* are deflected by the tetrahedral mirror of the first stage (lower stage), and the light beam passing through the cylindrical lens 2204*a* and the light beam passing through the cylindrical lens 2204*d* are deflected by the tetrahedral mirror of the second stage (upper stage).

In addition, the light beams passing through the cylindrical lens 2204*a* and the cylindrical lens 2204*b* are deflected to the −X side of the polygon mirror 2104, and the light beams passing through the cylindrical lens 2204*c* and the cylindrical lens 2204*d* are deflected to the +X side of the polygon mirror 2104.

Each scanning lens has optical power for collecting the light beam near the photosensitive element corresponding thereto and optical power for moving a light spot at the same speed in the main-scanning direction on the surface of the photosensitive element corresponding thereto in accordance with the rotation of the polygon mirror 2104.

The scanning lens 2105*a* and the scanning lens 2105*b* are arranged on the −X side of the polygon mirror 2104, and the scanning lens 2105*c* and the scanning lens 2105*d* are arranged on the +X side of the polygon mirror 2104.

The scanning lens 2105*a* and the scanning lens 2105*b* are stacked in the Z axis direction, the scanning lens 2105*b* faces the tetrahedral mirror of the first stage, and the scanning lens 2105*a* faces the tetrahedral mirror of the second stage. In addition, the scanning lens 2105*c* and the scanning lens 2105*d* are stacked in the Z axis direction, the scanning lens 2105*c* faces the tetrahedral mirror of the first stage, and the scanning lens 2105*d* faces the tetrahedral mirror of the second stage.

The light beam, which is deflected by the polygon mirror 2104, passing through the cylindrical lens 2204*a* is emitted to the photosensitive element 2030*a* through the scanning lens 2105*a* and the folding mirror 2106*a*, thereby forming a light spot. The light spot moves in the longitudinal direction of the photosensitive element 2030*a* in accordance with the rotation of the polygon mirror 2104. In other words, scanning is performed on the photosensitive element 2030*a*. The moving direction of the light spot at this time is the "main-scanning direction" in the photosensitive element 2030*a*, and the rotation direction of the photosensitive element 2030*a* is the "sub-scanning direction" in the photosensitive element 2030*a*.

In addition, the light beam, which is deflected by the polygon mirror 2104, passing through the cylindrical lens 2204*b* is emitted to the photosensitive element 2030*b* through the scanning lens 2105*b*, the folding mirror 2106*b*, and the folding mirror 2108*b*, thereby forming a light spot. The light spot moves in the longitudinal direction of the photosensitive element 2030*b* in accordance with the rotation of the polygon mirror 2104. In other words, scanning is performed on the photosensitive element 2030*b*. The moving direction of the light spot at this time is the "main-scanning direction" in the photosensitive element 2030*b*, and the rotation direction of the photosensitive element 2030*b* is the "sub-scanning direction" in the photosensitive element 2030*b*.

The light beam, which is deflected by the polygon mirror 2104, passing through the cylindrical lens 2204*c* is emitted to the photosensitive element 2030*c* through the scanning lens 2105*c*, the folding mirror 2106*c*, and the folding mirror 2108*c*, thereby forming a light spot. The light spot moves in the longitudinal direction of the photosensitive element 2030*c* in accordance with the rotation of the polygon mirror 2104. In other words, scanning is performed on the photosensitive element 2030*c*. The moving direction of the light spot at this time is the "main-scanning direction" in the photosensitive element 2030*c*, and the rotation direction of the photosensitive element 2030*c* is the "sub-scanning direction" in the photosensitive element 2030*c*.

In addition, the light beam, which is deflected by the polygon mirror 2104, passing through the cylindrical lens 2204*d* is emitted to the photosensitive element 2030*d* through the scanning lens 2105*d* and the folding mirror 2106*d*, thereby forming a light spot. The light spot moves in the longitudinal direction of the photosensitive element 2030*d* in accordance with the rotation of the polygon mirror 2104. In other words, scanning is performed on the photosensitive element 2030*d*. The moving direction of the light spot at this time is the "main-scanning direction" in the photosensitive element 2030*d*, and the rotation direction of the photosensitive element 2030*d* is the "sub-scanning direction" in the photosensitive element 2030*d*.

Here, the folding mirrors are arranged such that the lengths of optical paths formed from the polygon mirror 2104 to the photosensitive elements coincide with one another, and the incident positions and the incidence angles of the light beams in the photosensitive elements are the same.

The optical system arranged on an optical path formed between the polygon mirror 2104 and each photosensitive element is also called a scanning optical system. Here, the scanning optical system of the K station is configured by the scanning lens 2105*a* and the folding mirror 2106*a*. In addition, the scanning optical system of the C station is configured by the scanning lens 2105*b* and two folding mirrors (2106*b* and 2108*b*). The scanning optical system of the M station is configured by the scanning lens 2105*c* and two folding mirrors (2106*c* and 2108*c*). Furthermore, the scanning optical system of the Y station is configured by the scanning lens 2105*d* and the folding mirror 2106*d*. In each scanning optical system, the scanning lens may be configured by a plurality of lenses.

Figure 8:
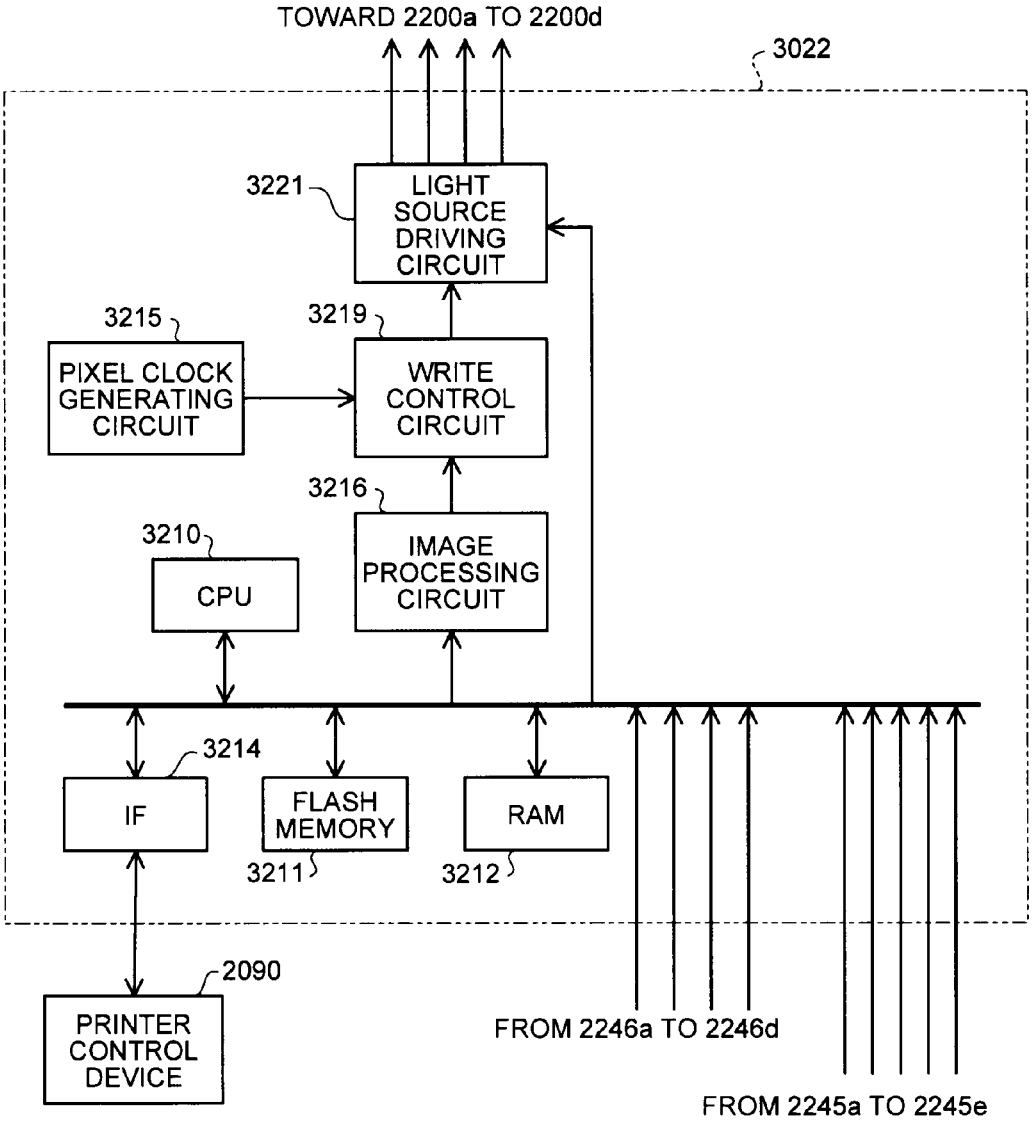
FIG. 8 is a block diagram illustrating a scanning control device.
Figure 9:
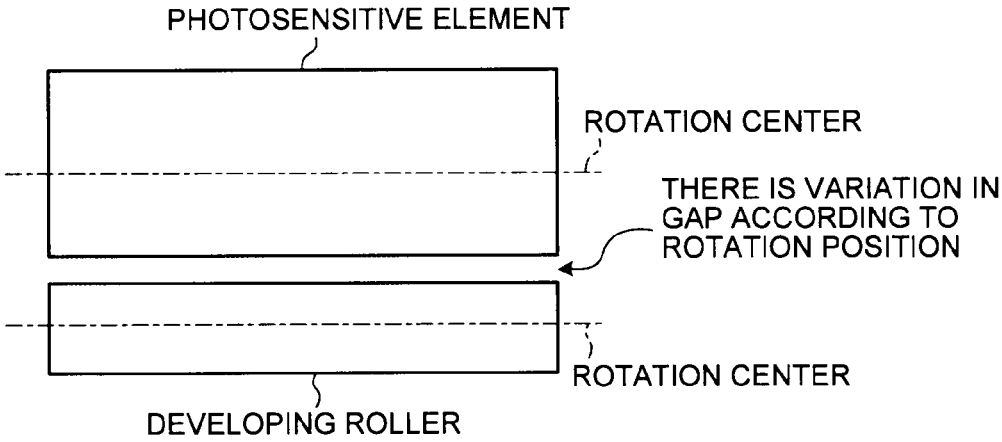
FIG. 9 is a diagram illustrating the eccentricity of a photosensitive element.
Figure 10:
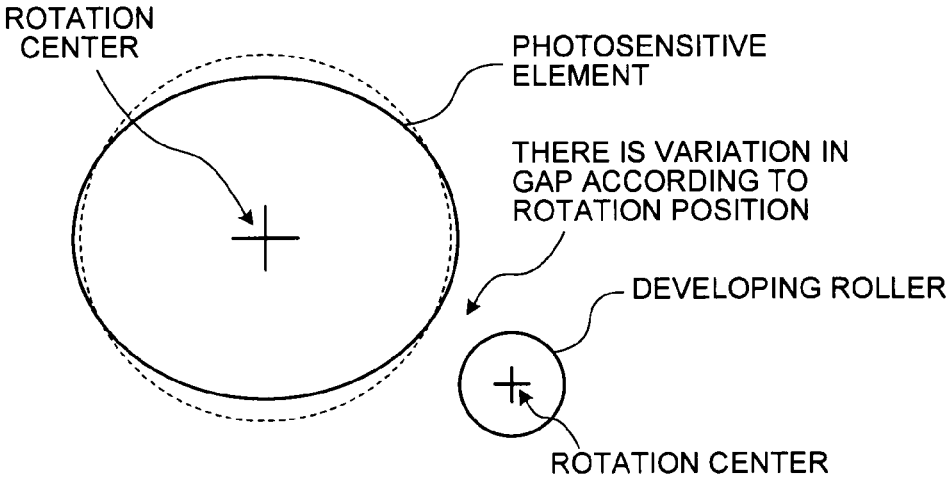
FIG. 10 is a diagram illustrating a form error of a photosensitive element.
Figure 11:
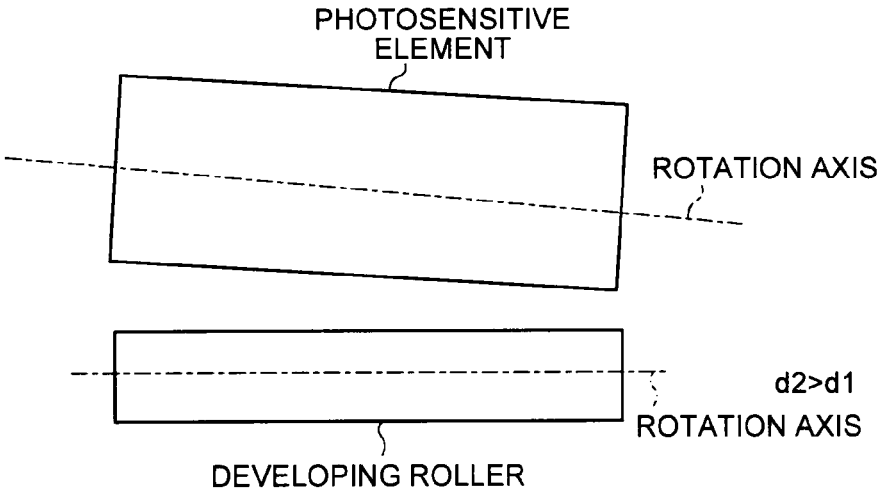
FIG. 11 is a diagram illustrating a nonparallel state of the rotating shaft of the photosensitive element and the rotating shaft of a developing roller.

The scanning control device 3022, for example, as illustrated in FIG. 8, includes a CPU 3210, a flash memory 3211, a RAM 3212, an interface (IF) 3214, a pixel clock generating circuit 3215, an image processing circuit 3216, a write control circuit 3219, a light source driving circuit 3221, and the like. In addition, arrows shown in FIG. 8 illustrate the flows of representative signals and information, and not all the connection relations of blocks are illustrated.

The IF 3214 is a communication interface that controls two-way communication with the printer control device 2090. The image data transmitted from a higher-level device is supplied through the IF 3214.

The pixel clock generating circuit 3215 generates a pixel clock signal. In addition, the pixel clock signal can be phase-modulated with the resolving power of ⅛ clock.

After predetermined halftone processing or the like is performed for the image data that is raster-developed by the CPU 3210 for each color, the image processing circuit 3216 generates dot data for each light emitting element of each light source.

The write control circuit 3219 acquires the operational timing for starting writing based on an output signal of a synchronization detecting sensor not illustrated in the figure for each image forming station. Then, the write control circuit 3219 superimposes the dot data of each light emitting element on the pixel clock signal transmitted from the pixel clock generating circuit 3215 in accordance with the operational timing to start writing and generates modulation data that is independent for each light emitting element.

The light source driving circuit 3221 outputs a driving signal of each light emitting element to each light source in accordance with each modulation data transmitted from the write control circuit 3219.

In the flash memory 3211, various programs described in a code that can be decoded by the CPU 3210 and various kinds of data necessary for executing the programs are stored.

The RAM 3212 is a memory used for a work.

The CPU 3210 operates in accordance with a program stored in the flash memory 3211 and controls the overall operation of the optical scanning device 2010.

However, as described above, in a case where there is eccentricity or a form error in the photosensitive element (see FIGS. 9 and 10), an unnecessary density variation in the sub-scanning direction occurs in an output image. In addition, in a case where the rotation axis of the photosensitive element and the rotation axis of the developing roller are unparallel to each other (see FIG. 11), an unnecessary density variation in the main-scanning direction occurs in the output image.

Thus, the CPU 3210 acquires light amount correcting information that is used for suppressing a density variation in the sub-scanning direction and a density variation in the main-scanning direction, which are not necessary, at predetermined operational timing. Hereinafter, the process of acquiring the light amount correcting information will be abbreviated to a "light amount correcting information acquiring process".

As the predetermined operational timing, at the time of inputting power, (1) when a stop time of the photosensitive element is six hours or more, (2) when the temperature of the inside of the apparatus changes by 10° C. or more, or (3) when the relative humidity of the inside of the apparatus changes by 50% or more, and, at the time of printing, (4) when the number of prints reaches a predetermined number of prints, (5) when the number of rotations of the developing roller reaches a predetermined number of times, or (6) when the travel distance of the transfer belt reaches a predetermined distance, or the like, the light amount correcting information acquiring process is performed.

Figure 12:
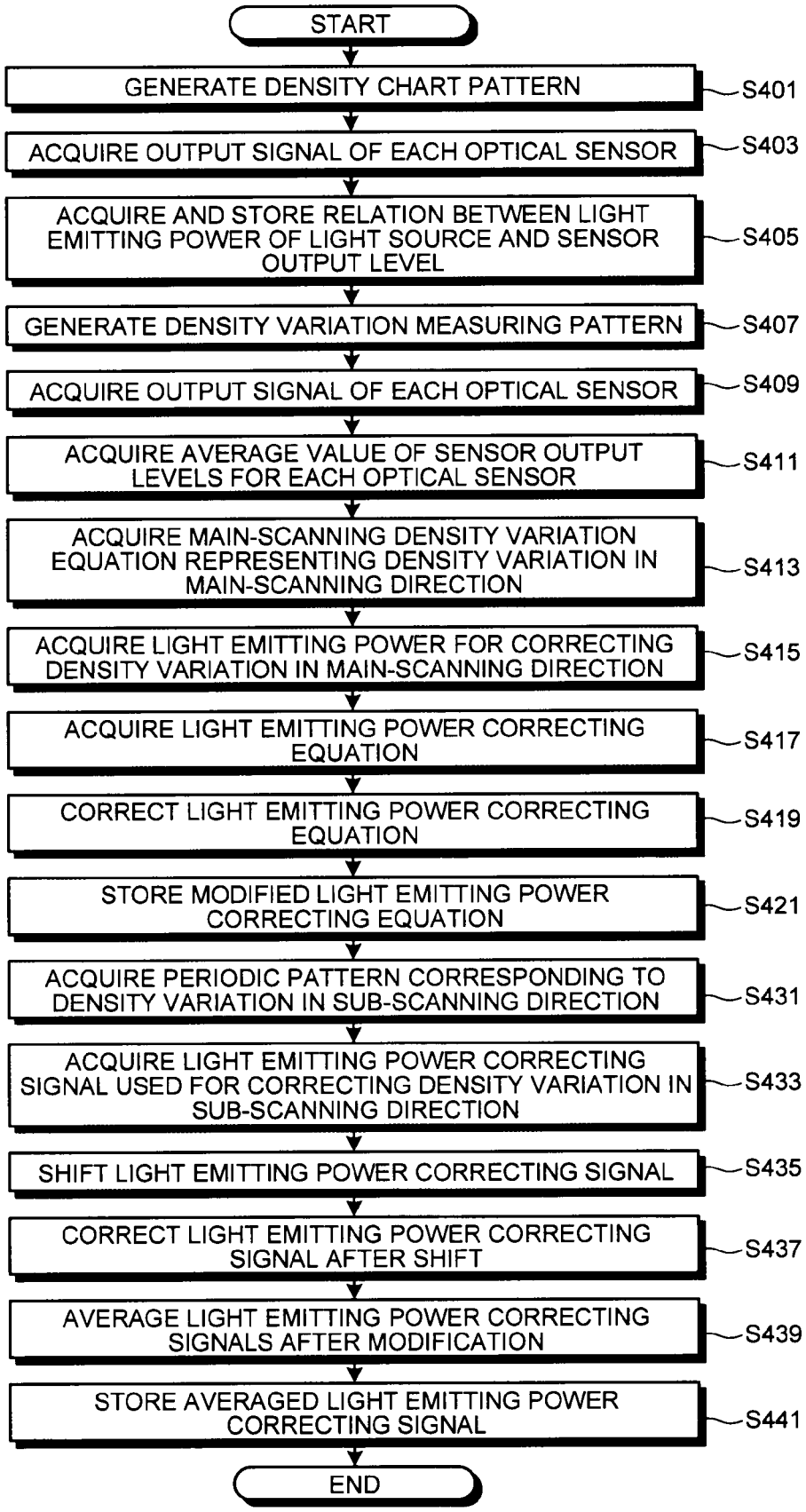
FIG. 12 is a flowchart illustrating a process of acquiring light amount correcting information.

Here, the light amount correcting information acquiring process will be described with reference to FIG. 12. The flowchart illustrated in FIG. 12 corresponds to a series of processing algorithms that is performed by the CPU 3210 in the light amount correcting information acquiring process. Here, although the light amount correcting information acquiring process is performed for each station, the process is similarly performed in each station, and thus the light amount correcting information acquiring process performed in the K station will be representatively described here. In addition, although shading correction is typically performed, for easy understanding of the description, here, it is assumed that the shading correction is not performed for descriptive purposes.

Figure 13:
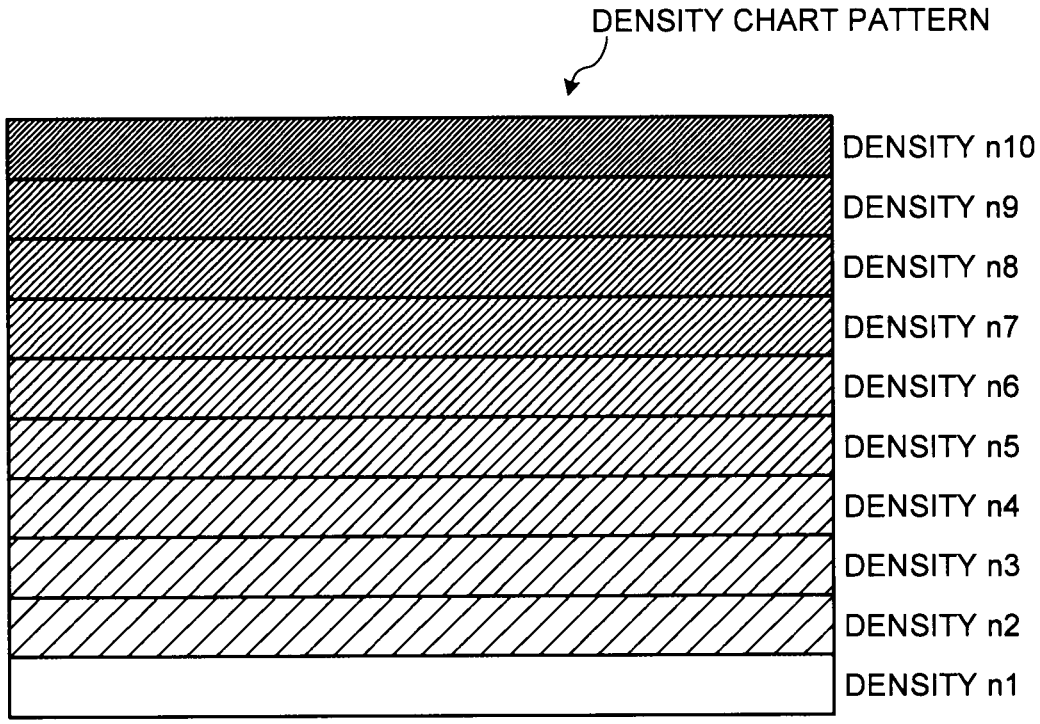
FIG. 13 is a diagram illustrating a density chart pattern.
Figure 14:
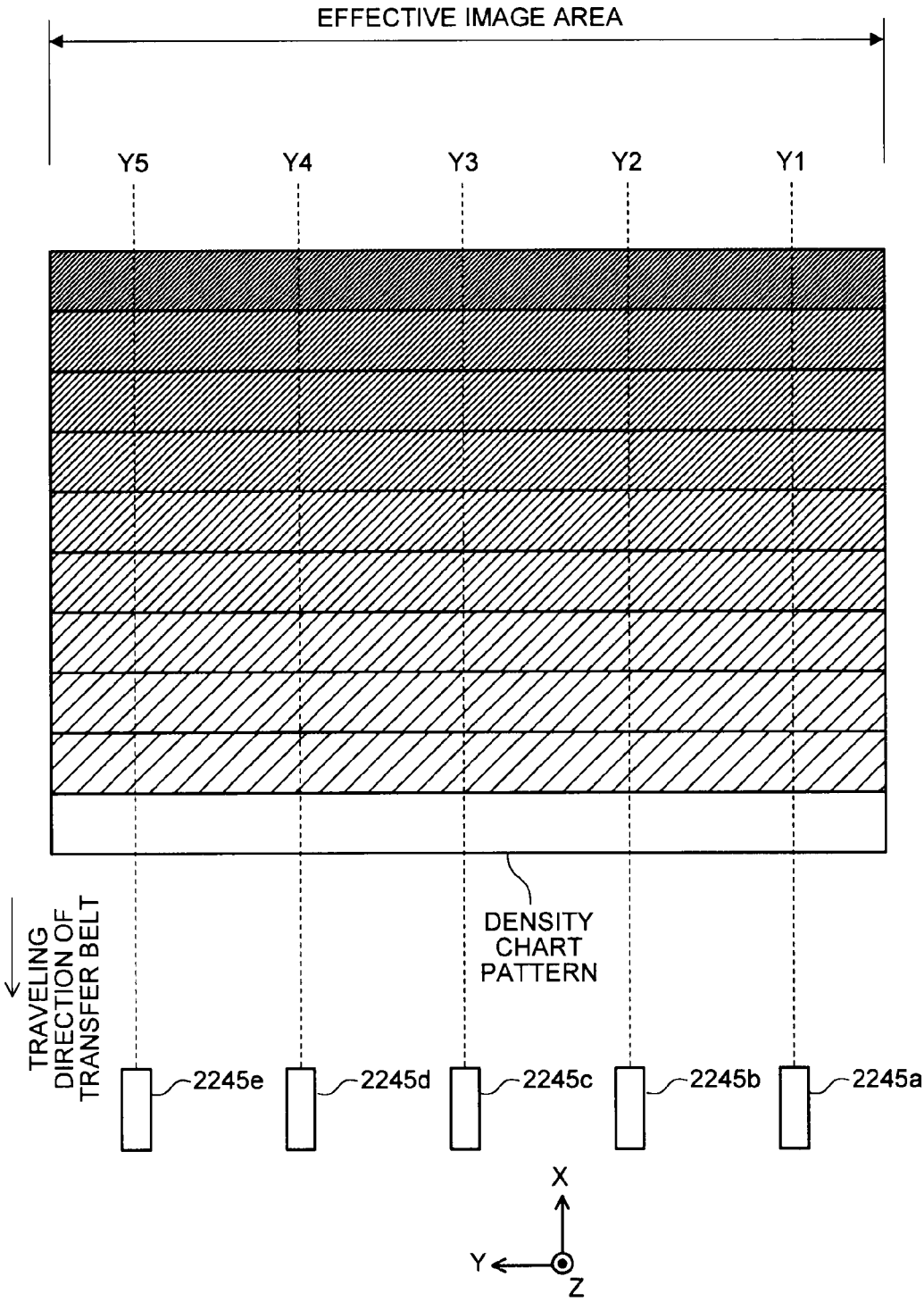
FIG. 14 is a diagram illustrating the positional relation between the density chart pattern and each optical sensor.
Figure 15:
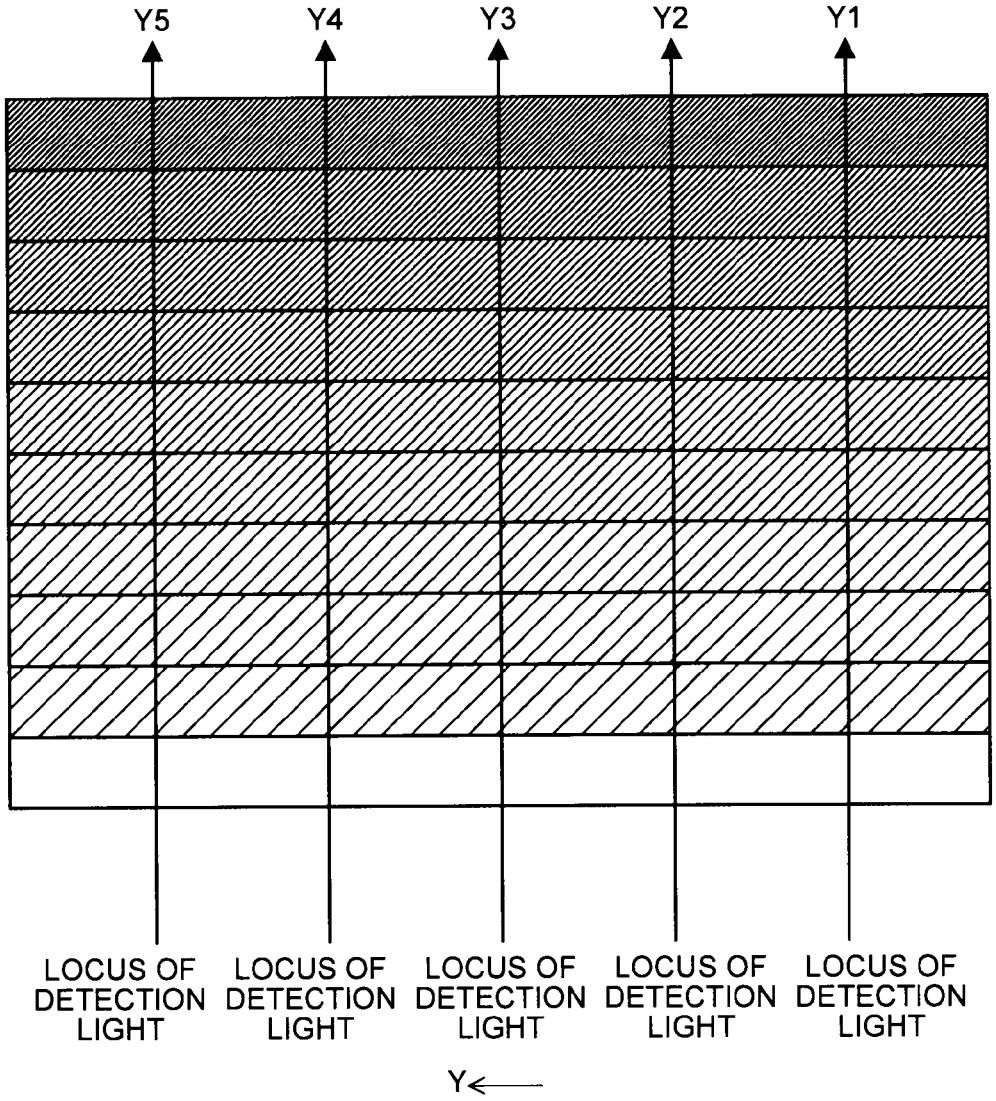
FIG. 15 is a diagram illustrating the locus of detection light emitted from each optical sensor in the process of acquiring light amount correcting information.
Figure 16A:
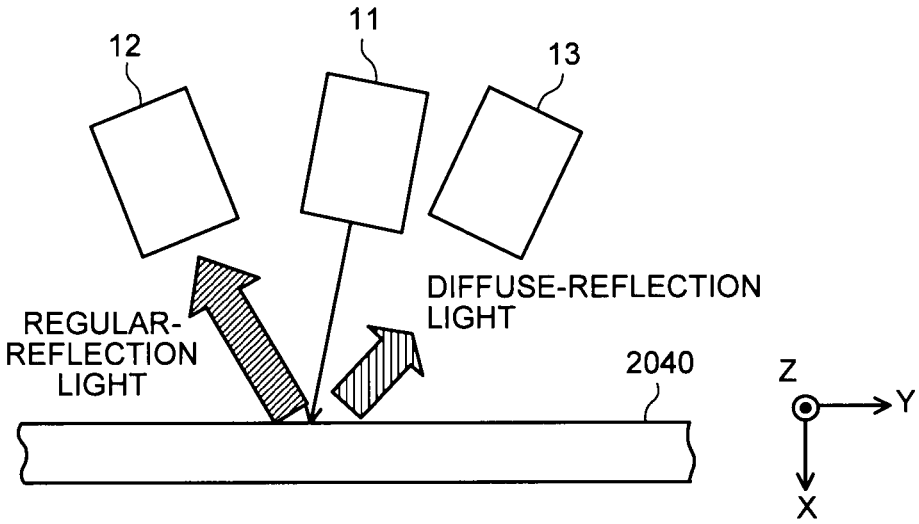
FIG. 16A is a diagram illustrating regular-reflection light and diffuse-reflection light when the illumination target of detection light is a transfer belt.
Figure 16B:
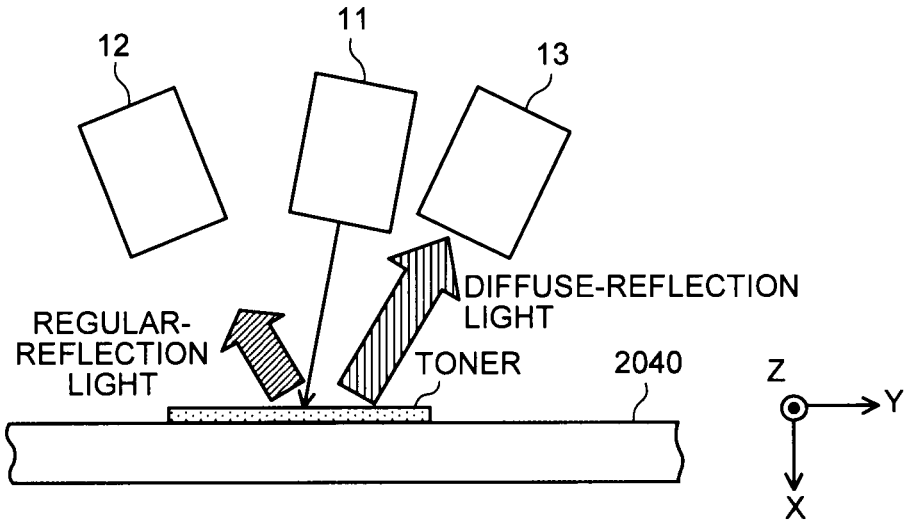
FIG. 16B is a diagram illustrating regular-reflection light and diffuse-reflection light when the illumination target of the detection target is a toner pattern.

In Step S401 performed first, for example, as illustrated in FIG. 13, for black, a density chart pattern including a plurality of areas having different toner densities, for example, as illustrated in FIG. 14, is formed so as to have approximately the same size as the effective image area in the Y axis direction.

Here, for example, the density chart pattern includes areas of densities (n1 to n10) of 10 kinds. The density n1 is the lowest density, and the density n10 is the highest density. In order to form the density chart pattern, the turning-on time of the light emitting element is set to be constant regardless of the density, and only the light emitting power is set to be different in accordance with the density. Here, light emitting power corresponding to the density n1 is denoted by p1, light emitting power corresponding to the density n2 is denoted by p2, . . . , and light emitting power corresponding to the density n10 is denoted by p10.

Next in Step S403, the LED 11 of each optical sensor is turned on. The light (detection light) emitted from the LED 11 sequentially is to be emitted to the area of the density n1 to the area of the density n10 in the density chart pattern in accordance with the rotation of the transfer belt 2040, in other words, in accordance with the time elapsed (see FIG. 15).

Then, the output signals of the regular-reflection light receiving element 12 and the diffuse-reflection light receiving element 13 are acquired.

In a case where toner is not attached to the transfer belt 2040, in the detection light reflected by the transfer belt 2040, a regular-reflection light component is more than a diffuse-reflection light component. Thus, while a large amount of light is incident to the regular-reflection light receiving element 12, little amount of light is incident to the diffuse-reflection light receiving element 13 (see FIG. 16A).

On the other hand, in a case where toner is attached to the transfer belt 2040, compared to a case where toner is not attached thereto, the regular-reflection light component decreases, and the diffuse-reflection light component increases. Accordingly, the light incident to the regular-reflection light receiving element 12 decreases, and the light incident to the diffuse-reflection light receiving element 13 increases (see FIG. 16B).

In other words, it is possible to detect the density of toner attached to the transfer belt 2040 based on the output levels of the regular-reflection light receiving element 12 and the diffuse-reflection light receiving element 13.

Next in Step S405, for each optical sensor, the output level of the diffuse-reflection light receiving element 13 is normalized by using the following Equation (1) for each density included in the density chart pattern. Hereinafter, the normalized output level L of the diffuse-reflection light receiving element 13 will be also referred to as a "sensor output level" for convenience of the description.

$$L=(\text{output level of diffuse-reflection light receiving element 13})\div\{(\text{output level of regular-reflection light receiving element 12})+(\text{output level of diffuse-reflection light receiving element 13})\} \quad \text{Equation (1)}$$

Figure 17:
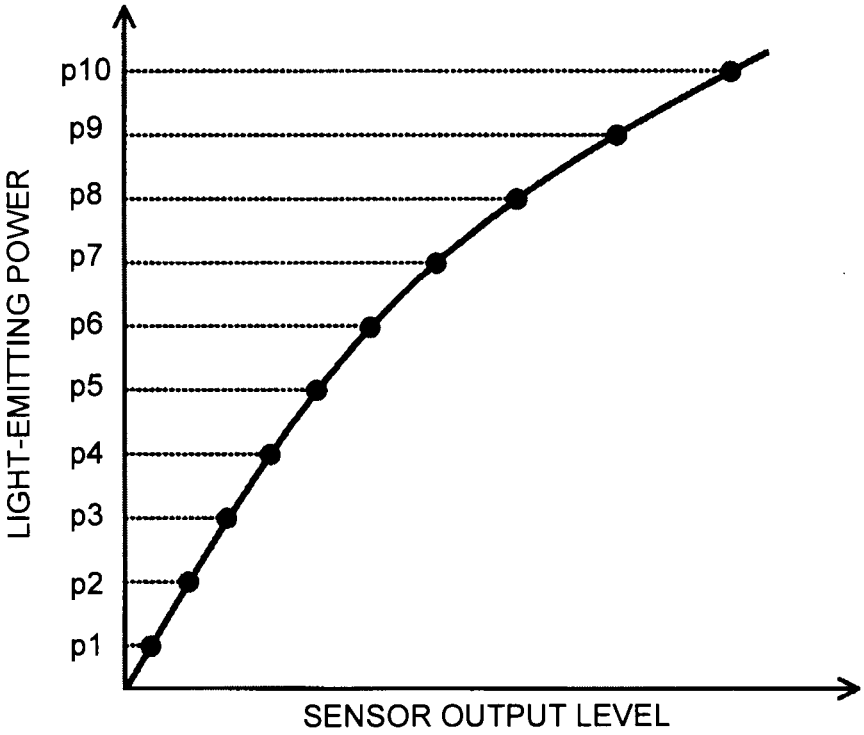
FIG. 17 is a diagram illustrating the relation between light emission power and a sensor output level.
Figure 18:
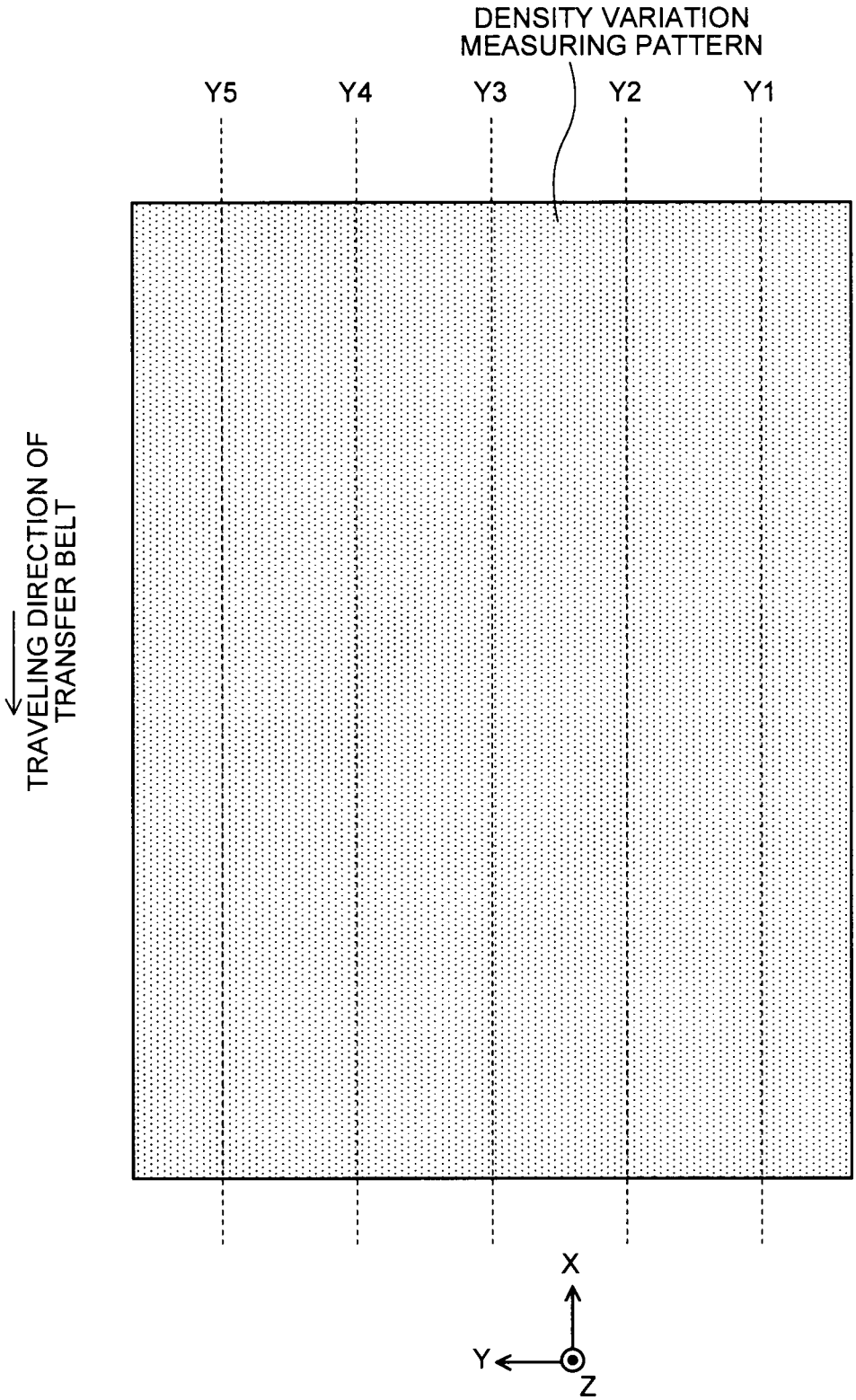
FIG. 18 is a diagram illustrating a density variation measuring pattern.
Figure 19:
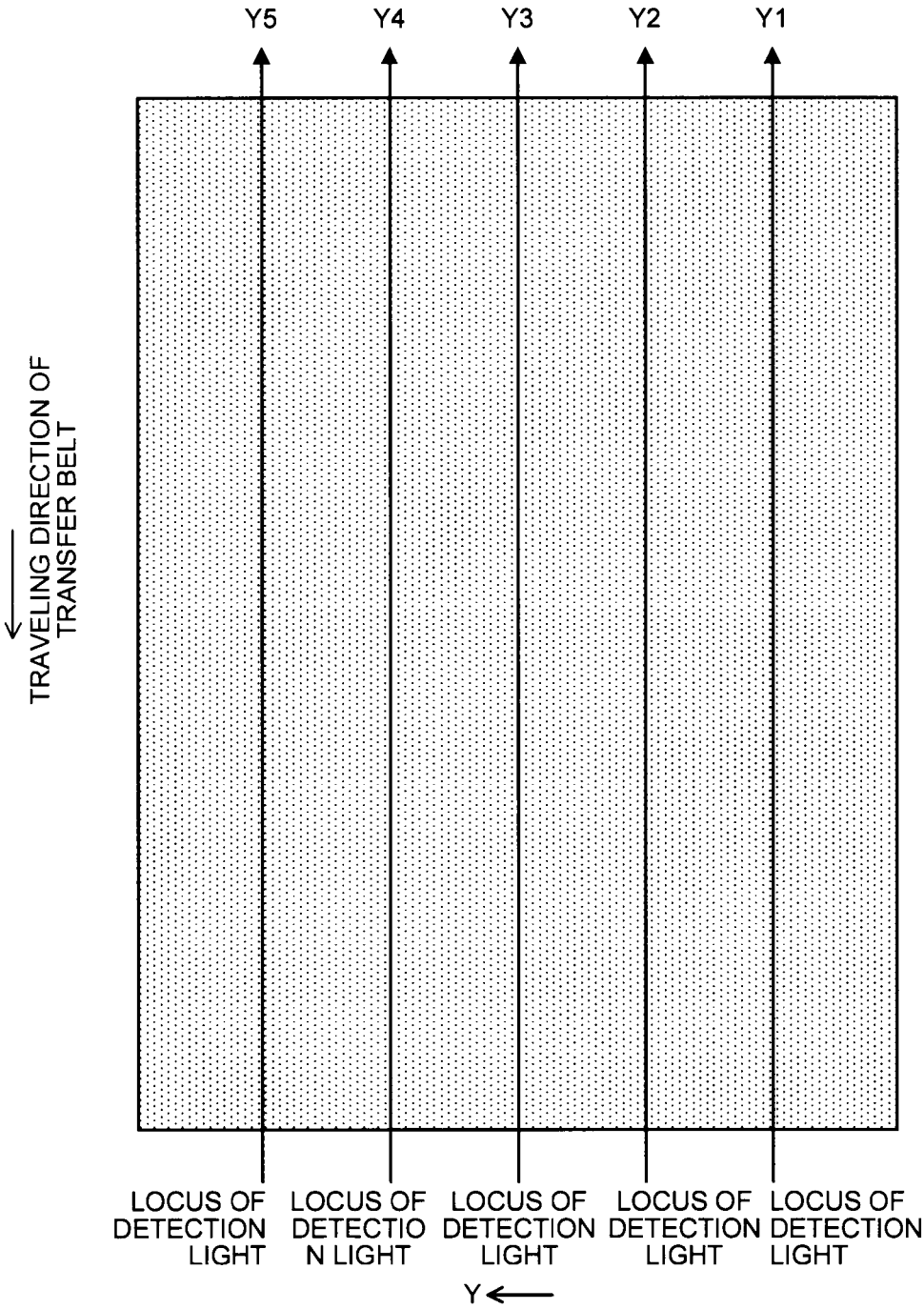
FIG. 19 is a diagram illustrating the locus of detection light emitted from each optical sensor for a density variation measuring pattern.

Then, a correlation between the sensor output level and the light emitting power is acquired for each optical sensor (see FIG. 17). Here, the correlation is approximated by a polynomial expression, and the polynomial expression is stored in the flash memory 3211.

In addition, in this embodiment, the correlation between the sensor output level and the light emitting power is adjusted so as not to fluctuate in the five optical sensors.

Next in Step S407, a density variation measuring pattern is generated. Here, as the density variation measuring pattern, a black solid pattern is formed so as to have a vertical A3 size (see FIG. 18).

Next in Step S409, the LED 11 of each optical sensor is turned on. The detection light emitted from each LED 11 is to be emitted to the density variation measuring pattern in a direction corresponding to the sub-scanning in accordance with the rotation of the transfer belt 2040, in other words, in accordance with the time elapsed (see FIG. 19).

Figure 20:
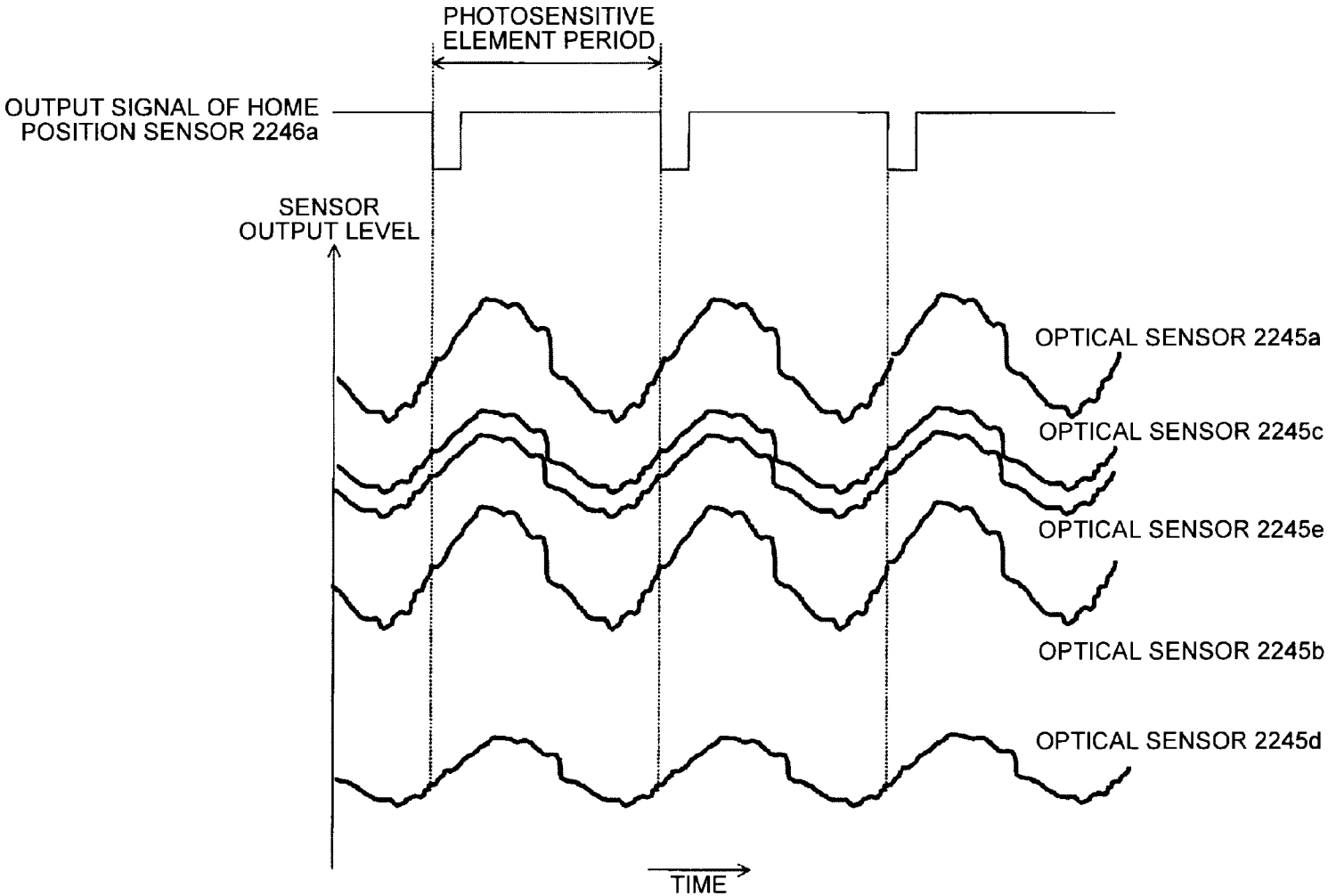
FIG. 20 is a timing diagram illustrating the sensor output level of each optical sensor for a density variation measuring pattern.

Then, for each optical sensor, the output signals of the regular-reflection light receiving element 12 and the diffuse-reflection light receiving element 13 are acquired at predetermined time intervals, and the sensor output level is calculated by using Equation (1) described above (see FIG. 20). In FIG. 20, the output signal of the home position sensor 2246*a* is also illustrated. Hereinafter, a change in the sensor output level with respect to time is also referred to as a "sensor output level waveform".

Next in Step S411, for each optical sensor, an average value of the sensor output levels is acquired. Hereinafter, for convenience of the description, the average value of the sensor output levels is abbreviated to a "level average value". In addition, the level average value of the optical sensor 2245*a* is denoted by Va, the level average value of the optical sensor 2245*b* is denoted by Vb, the level average value of the optical sensor 2245*c* is denoted by Vc, the level average value of the optical sensor 2245*d* is denoted by Vd, and the level average value of the optical sensor 2245*e* is denoted by Ve.

Figure 21:
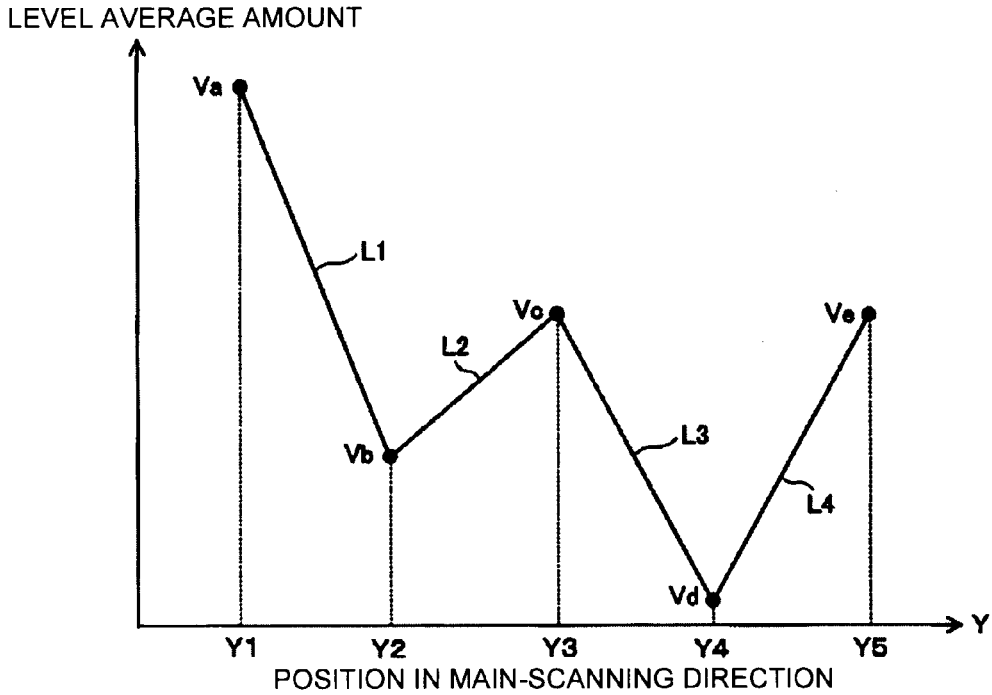
FIG. 21 is a diagram illustrating the relation between the positions of five optical sensors in the main-scanning direction and an average value of the levels of the five optical sensors.

Next in Step S413, equations (hereinafter, abbreviated to "main-scanning density variation equations") that represent a variation in the density in the main-scanning direction are acquired. Here, as shown in FIG. 21, an equation representing a straight line L1 that connects the level average values Va and Vb, an equation representing a straight line L2 that connects the level average values Vb and Vc, an equation representing a straight line L3 that connects the level average values Vc and Vd, and an equation representing a straight line L4 that connects the level average values Vd and Ve are the main-scanning density variation equations. In addition, a polygonal line formed by the four straight lines (straight lines L1 to L4) is referred to as a "main-scanning density variation polygonal line".

Next in Step S415, light emitting power used for correcting the density variation in the main-scanning direction is acquired. Here, the main-scanning density variation polygonal line is vertically reversed, and the vertical axis is converted into the light emitting power by using the correlation between the sensor output level and the light emitting power (see FIG. 22). Here, the light emitting power at the position Y1 is denoted by P1, the light emitting power at the position Y2 is denoted by P2, the light emitting power at the position Y3 is denoted by P3, the light emitting power at the position Y4 is denoted by P4, and the light emitting power at the position Y5 is denoted by P5.

Figure 22:
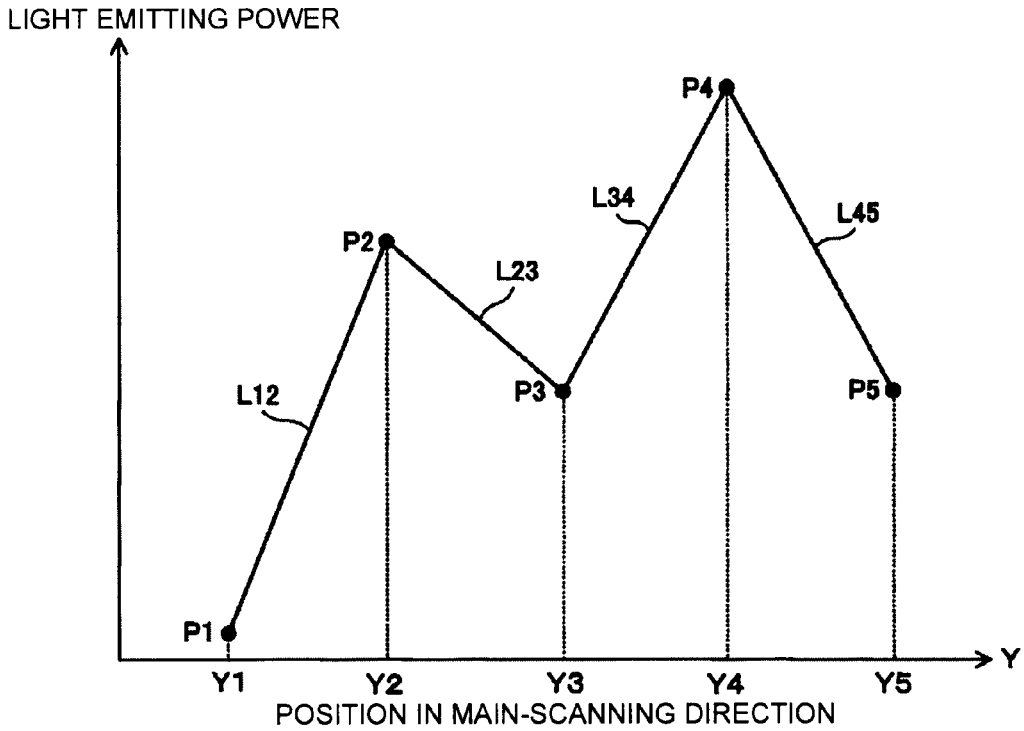
FIG. 22 is a diagram illustrating a light emission power correcting equation that represents the relation between the position in the main-scanning direction and the light emission power used for correcting the density variation.

Next in Step S417, light emitting power correcting equations that represent the relations between the position in the main-scanning direction and the light emitting power used for correcting the density variation are acquired. Here, as shown in FIG. 22, an equation representing a straight line L12 that connects the positions P1 and P2, an equation representing a straight line L23 that connects the positions P2 and P3, an equation representing a straight line L34 that connects the positions P3 and P4, and an equation representing a straight line L45 that connects the positions P4 and P5 are the light emitting power correcting equations. In addition, a polygonal line formed by the four straight lines (straight lines L12, L23, L34, and L45) is referred to as a "light emitting power correcting polygonal line".

Here, in the light emitting power correcting polygonal line, the highest light emitting power is referred to as "light emitting power Pu", and the lowest light emitting power is referred to as "light emitting power Pd". Here, Pu=P4 and Pd=P1.

In a case where the density variation is decreased by correcting the amount of light emission of the light source, when the density correction is performed drastically, a steep density variation occurs. Even in a case where the steep density variation is about 2% to 3%, when viewed in the human eyes, vertical streaks may be generated in an output image.

In addition, a light source has a maximum rated output and a minimum rated output in its light emitting power. In a case where the light source is used with the maximum rated output exceeded, the operating life of the light source markedly decreases. In addition, in a case where the light emitting power is higher than the maximum rated output or lower than the minimum rated output, the optical response characteristics of the leading edge/falling edge for laser beams are degraded, and accordingly, there is a problem in that it is difficult to respond to a high-speed writing operation. Furthermore, in a case where the light emitting power is lower than the minimum rated output, the droop characteristics are degraded, whereby unevenness of the density of a halftone image may easily occur. Therefore, it is preferable to use a light source within a range between the maximum rated output and the minimum rated output.

Next in Step S419, the light emitting power correcting equations described above are modified.

Figure 23A:
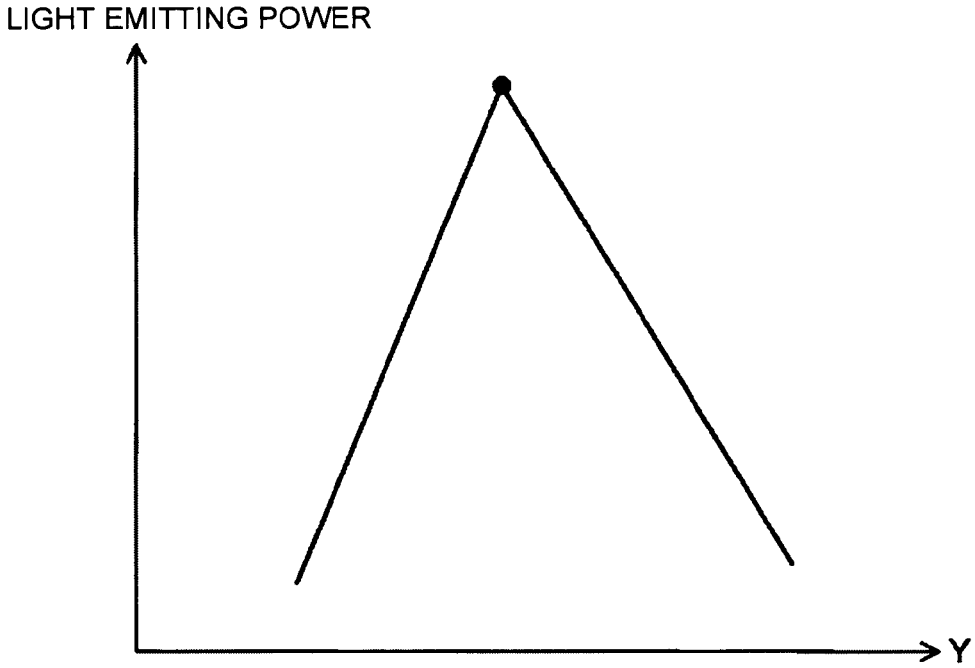
FIGS. 23A and 23B are diagrams (1) illustrating the modification of a light emission power correcting polygonal line.
Figure 23B:
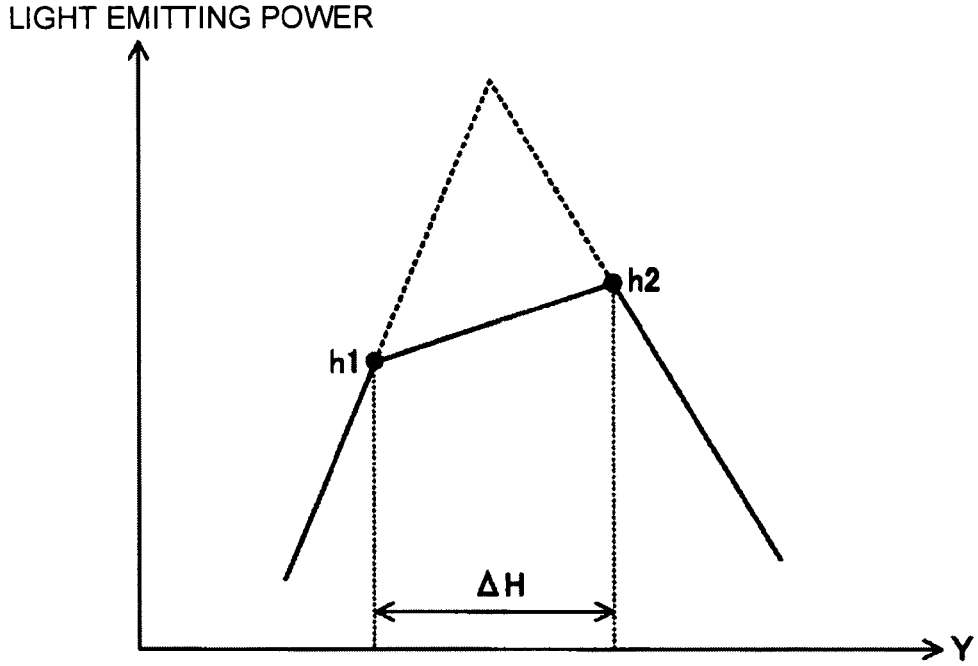

(1) For example, as illustrated in FIG. 23A, for an extreme value, at which a change in the light emitting power is steep, in the light emitting power correcting polygonal line, as illustrated in FIG. 23B, both ends (h1 and h2) of an interval ΔH in which the extreme value is included in the main-scanning direction are connected with a straight line, thereby alleviating a change in the light emitting power.

In a case where the interval ΔH is 5 mm or less, the density change can be easily visually noticed, and, in a case where the interval ΔH is 30 mm or more, there is a concern that the change in the light emitting power may be too steep in another image area. Thus, it is preferable to set the interval ΔH within a range more than 5 mm and less than 30 mm.

Figure 24:
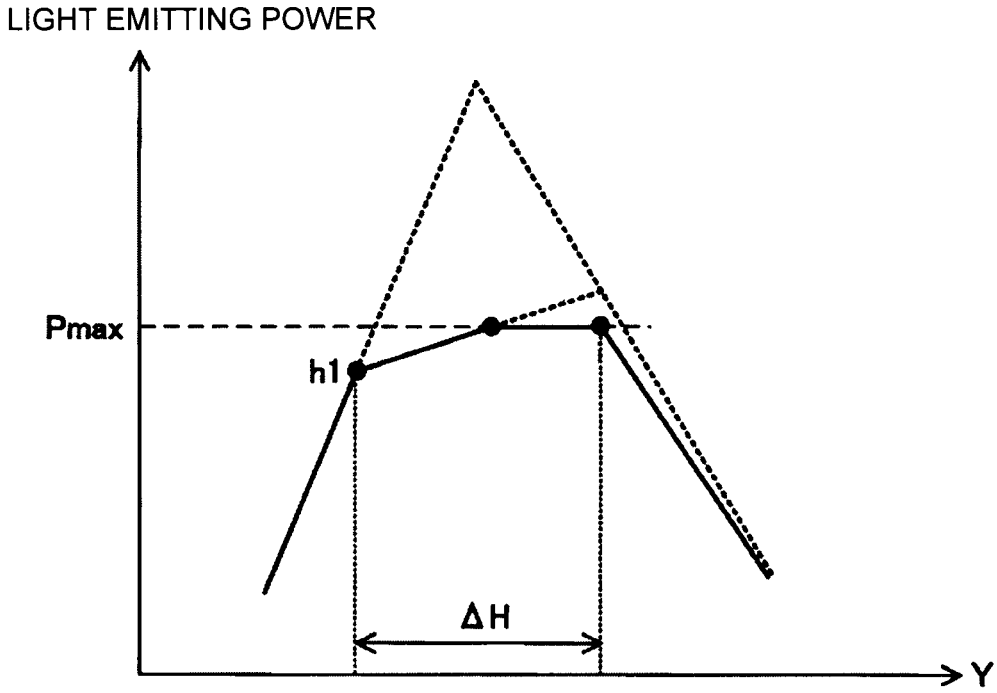
FIG. 24 is a diagram (2) illustrating the modification of the light emission power correcting polygonal line.

At this time, in a case where the light emitting power is higher than the maximum rated output Pmax, as illustrated in FIG. 24, a modification is additionally made such that the light emitting power is not higher than the maximum rated output Pmax.

In addition, in a case where the light emitting power is lower than the minimum rated output Pmin, a modification is additionally made such that the light emitting power is not lower than the minimum rated output Pmin.

Figure 25:
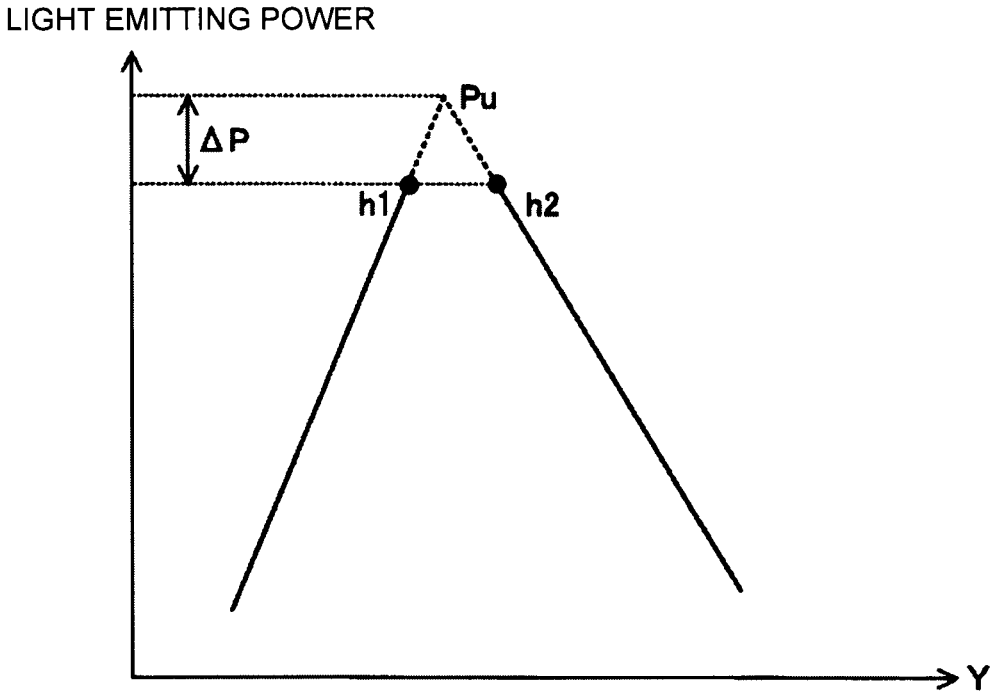
FIG. 25 is a diagram (3) illustrating the modification of the light emission power correcting polygonal line.

(2) For example, as illustrated in FIG. 25, two points (h1 and h2) at which the light emitting power is lower than the light emitting power Pu by ΔP are connected with a straight line, thereby alleviating a change in the light emitting power.

In addition, it is preferable to set ΔP within a range more than 10% of |Pu—Pd| and less than 20% of |Pu—Pd|. In a case where ΔP is 10% of |Pu—Pd| or less, the density change can be easily visually noticed, and, in a case where ΔP is 20% of |Pu—Pd| or more, there is a problem in that the change in the light emitting power may be too steep in another image area.

Figure 26:
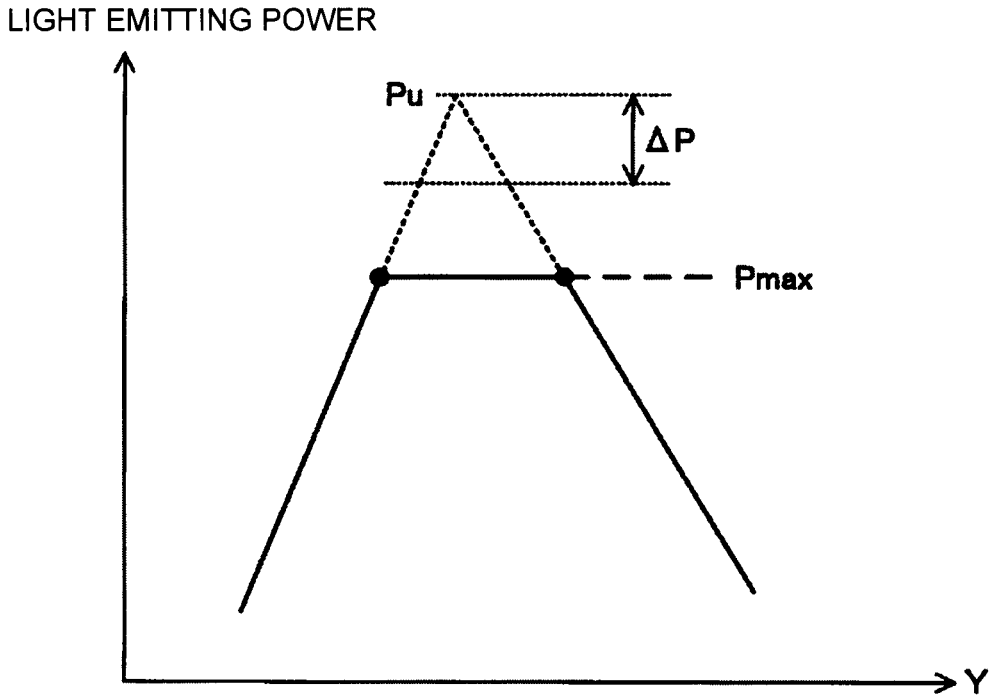
FIG. 26 is a diagram (4) illustrating the modification of the light emission power correcting polygonal line.

At this time, in a case where the light emitting power is higher than the maximum rated output Pmax, as illustrated in FIG. 26, a modification is additionally made such that the light emitting power is not higher than the maximum rated output Pmax.

In addition, in a case where the light emitting power is lower than the minimum rated output Pmin, a modification is additionally made such that the light emitting power is not lower than the minimum rated output Pmin.

Figure 27A:
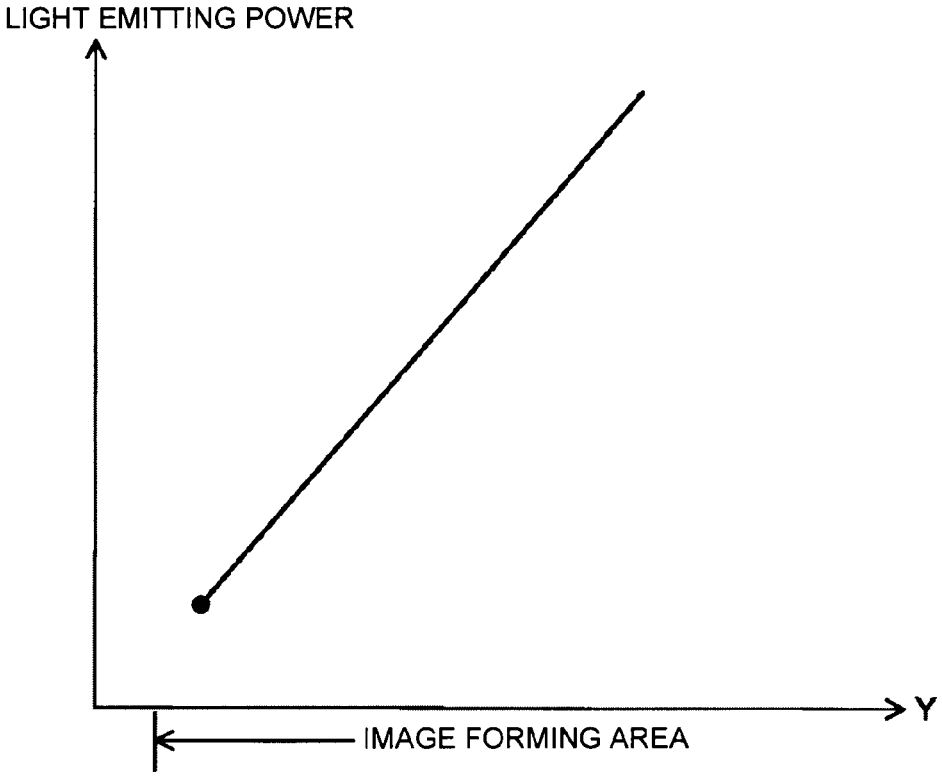
FIGS. 27A and 27B are diagrams (5) illustrating the modification of a light emission power correcting polygonal line.
Figure 27B:
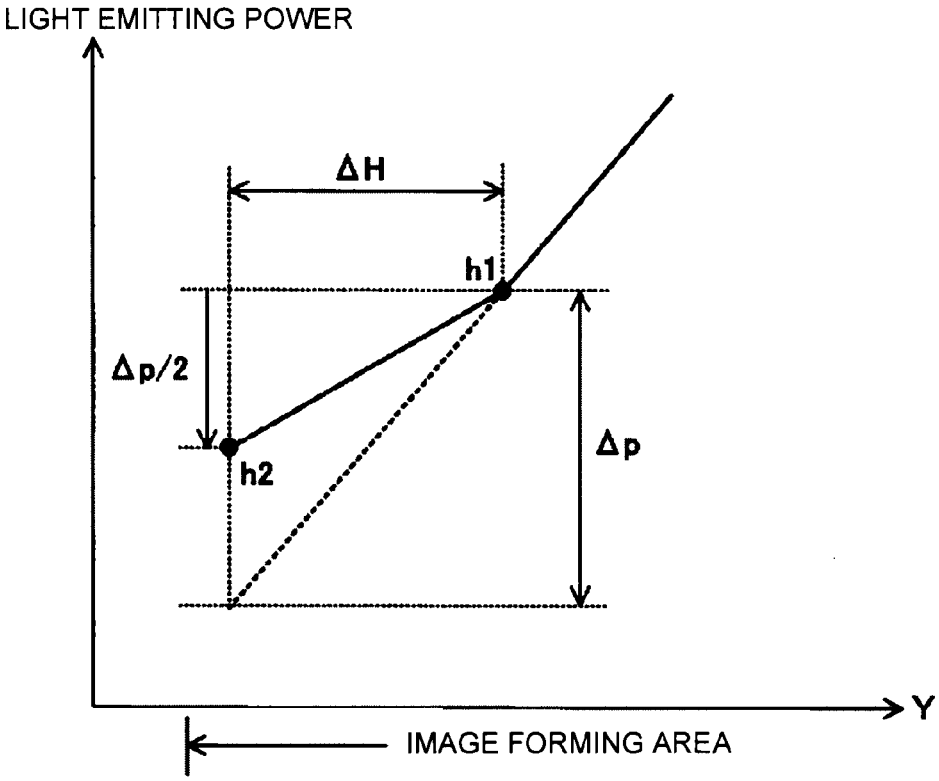

(3) As illustrated in FIGS. 27A and 27B, for an end portion of the light emitting power correcting polygonal line, a point h1 in an interval ΔH having the end portion as its one end is acquired, a point h2 is acquired at which the light emitting power has a difference of Δp/2 from the light emitting power at the point h1, wherein Δp is a difference between the light emitting power at the point h1 and the light emitting power at the end portion, and the two points (h1 and h2) are connected with a straight line, thereby alleviating the change in the light emitting power.

Figure 28:
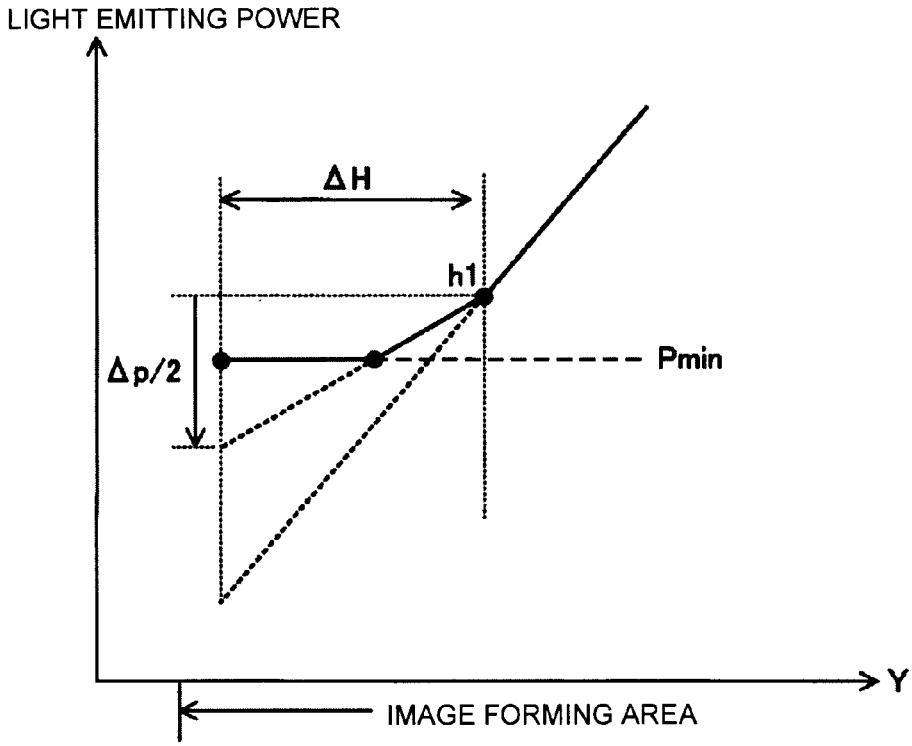
FIG. 28 is a diagram (6) illustrating the modification of the light emission power correcting polygonal line.

At this time, in a case where the light emitting power is lower than the minimum rated output Pmin, as shown in FIG. 28, a modification is additionally made such that the light emitting power is not lower than the minimum rated output Pmin.

Figure 29:
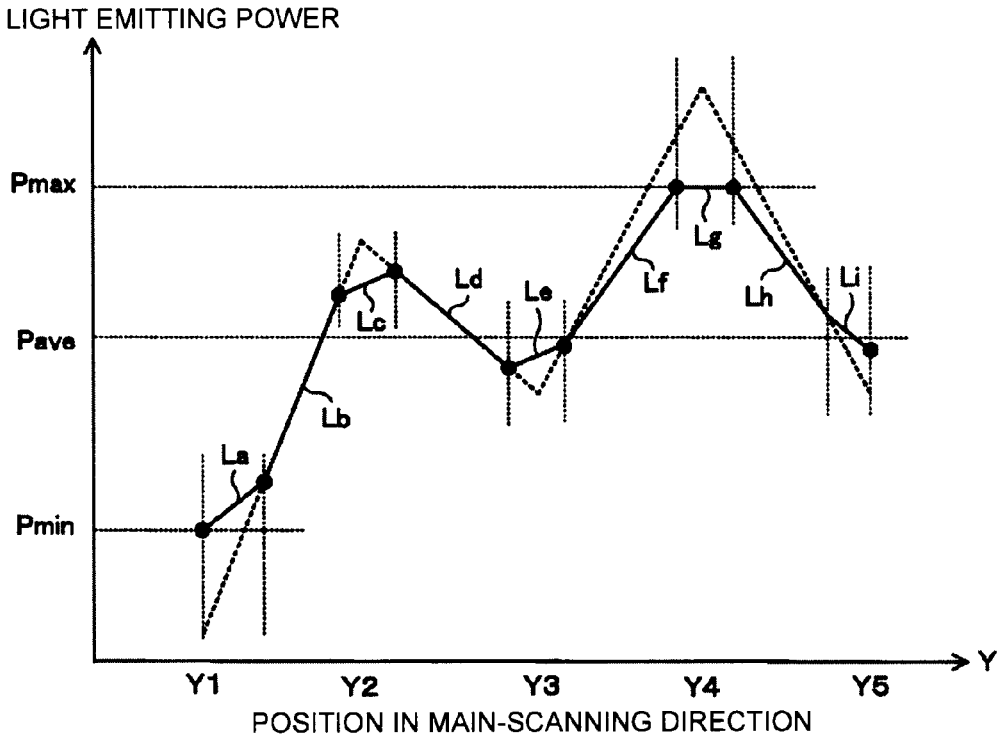
FIG. 29 is a diagram illustrating a modified light emission power correcting polygonal line.

The light emitting power polygonal line, which is modified as above, according to this embodiment is illustrated in FIG. 29. In addition, in FIG. 29, power Pave is an average light emitting power of the maximum rated output Pmax and the minimum rated output Pmin.

Next in Step S421, the modified light emitting power correcting equations are stored in the flash memory 3211. Here, equations representing nine straight lines (La to Li) illustrated in FIG. 29 are the modified light emitting power correcting equations.

Figure 30:
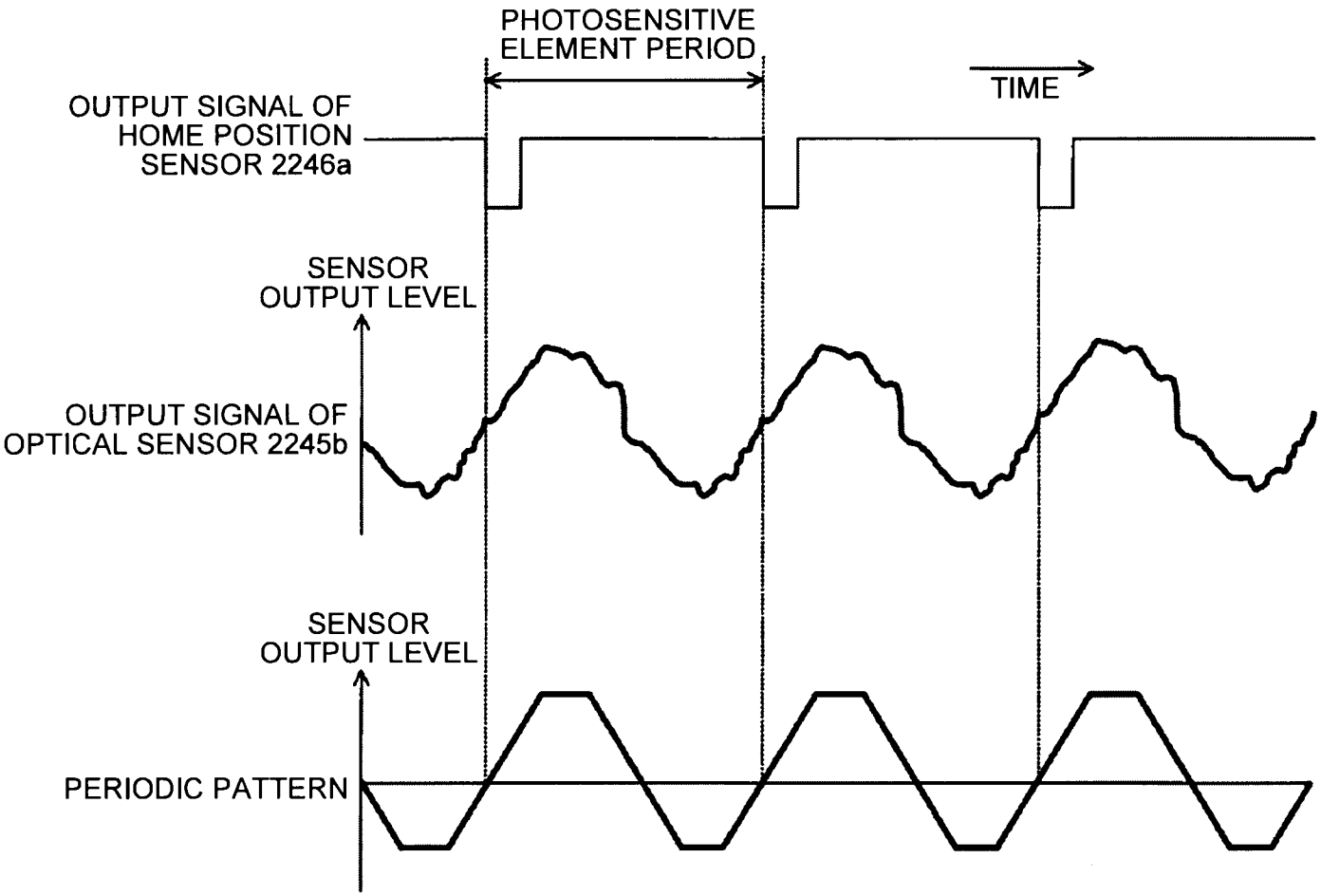
FIG. 30 is a timing diagram illustrating a periodic pattern.
Figure 31:
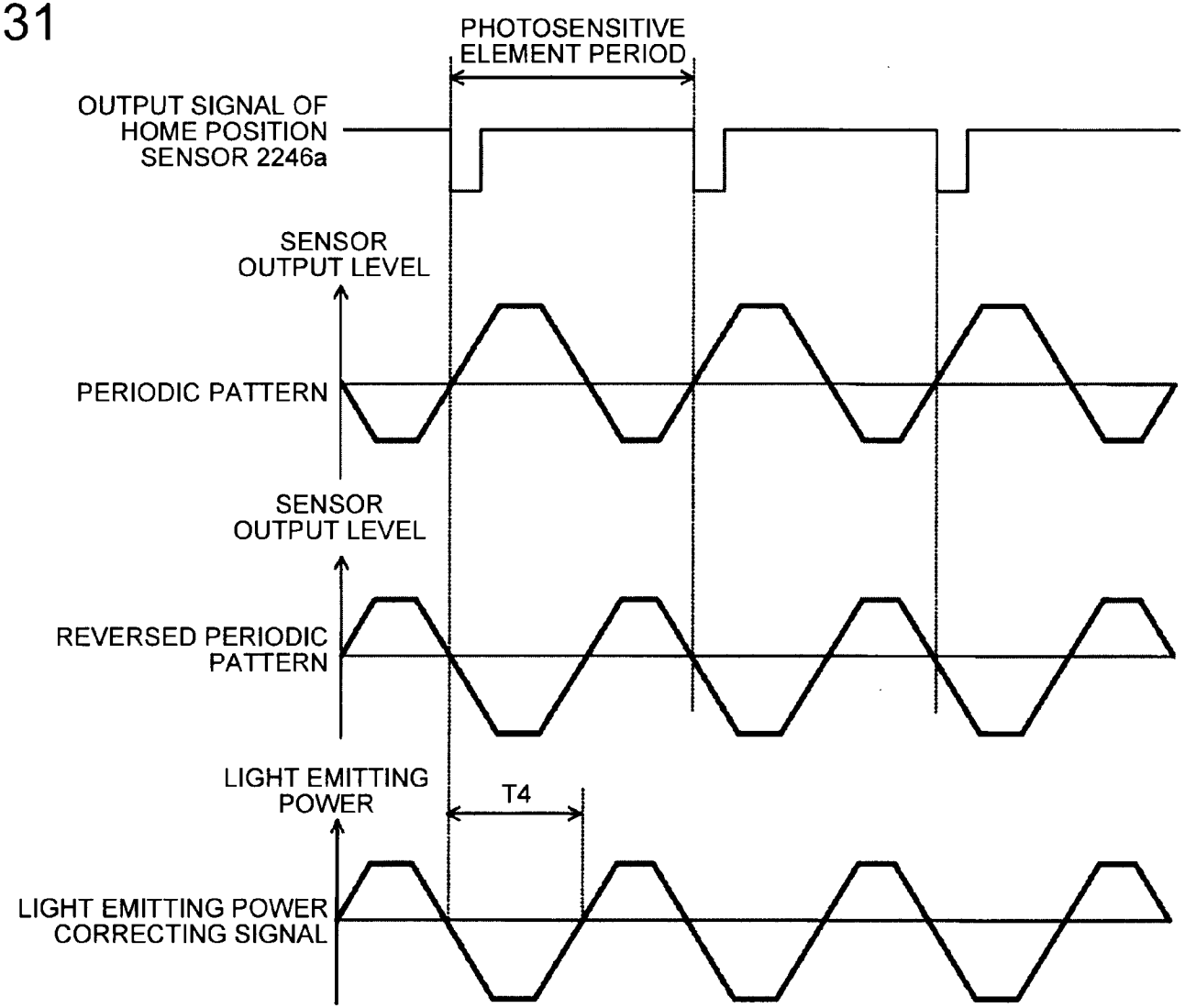
FIG. 31 is a timing diagram illustrating a light emission power correcting signal.

Next, in Step S431, a trapezoidal wave having the same period as the rotation period of the photosensitive element 2030*a* is extracted from the waveform of each sensor output level as a periodic pattern based on the output signal of the home position sensor 2246*a* (see FIG. 30).

Next, in Step S433, for each one of the positions Y1 to Y5, a light emitting power correcting signal used for correcting the density variation in the sub-scanning direction is acquired. Here, first, a reverse periodic pattern acquired by vertically reversing the above-described periodic pattern is acquired (see FIG. 31). Then, the vertical axis is converted from the sensor output level to the light emitting power so as to acquire a light emitting power correcting signal by referring to the correlation between the sensor output level and the light emitting power (see FIG. 31).

Next in Step S435, each light emitting power correcting signal is shifted such that the average power coincides with the modified light emitting power correcting equations.

Next in Step S437, for each shifted light emitting power correcting signal, a portion at which the light emitting power is higher than the maximum rated output Pmax is modified such that the light emitting power is at the maximum rated power Pmax or less, and a portion at which the light emitting power is lower than the minimum rated output Pmin is modified such that the light emitting power is at the minimum rated output Pmin or more.

Next in Step S439, the modified five light emitting power correcting signals are averaged for each position in the sub-scanning direction.

Next in Step S441, the averaged light emitting power correcting signal is stored in the flash memory 3211. Then, the light amount correcting information acquiring process ends.

Figure 32:
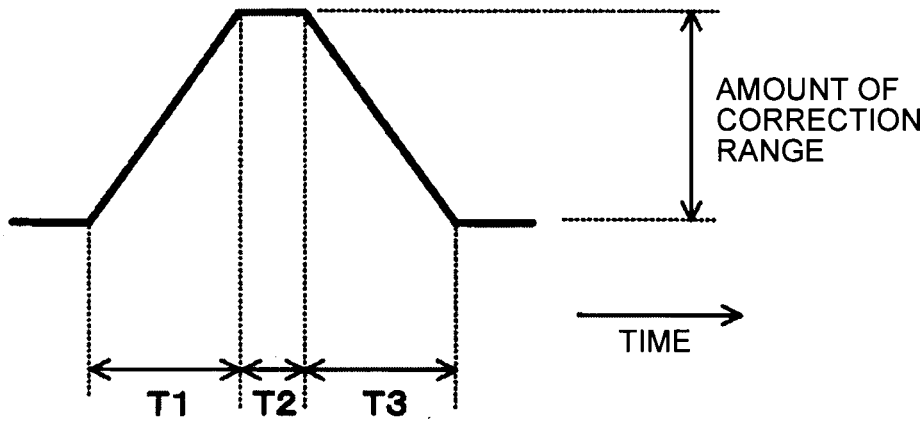
FIG. 32 is a diagram illustrating data that is necessary for defining a trapezoidal wave.

A trapezoidal wave signal, for example, as illustrated in FIG. 32, can be generated when an increment time T1, a peak time T2, a decrement time T3, the amount of the correction range, and a phase shift time (T4; see FIG. 31) for the period of the photosensitive element are known.

The increment time T1 is acquired based on the waveform of the sensor output level. The peak time T2 may be acquired based on the waveform of the sensor output level or T1/2. The decrement time T3 has basically the same value as that of the increment time T1. The phase shift time T4 (see FIG. 31) is used for phase adjustment between the period of the photosensitive element and the operational timing for starting writing. In addition, at the time of the first rotation of the photosensitive element, a default period set in advance is defined.

Figure 33:
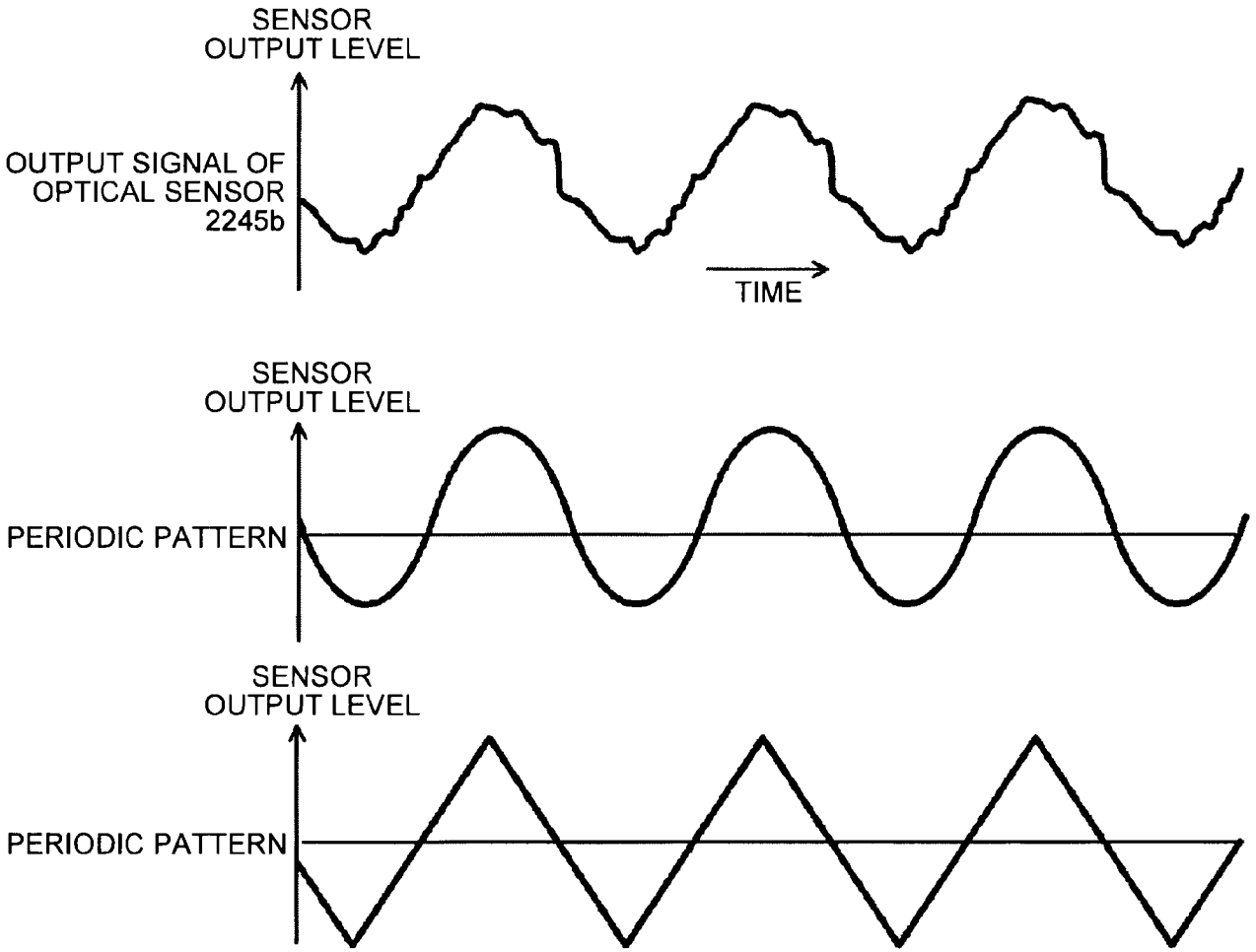
FIG. 33 is a timing diagram illustrating a comparative example of the periodic pattern.

FIG. 33 illustrates a case where a sinusoidal wave and a triangular wave that have the same period as the rotation period of the photosensitive element 2030*a* are extracted from the waveform of each sensor output level as a comparative example.

Figure 34:
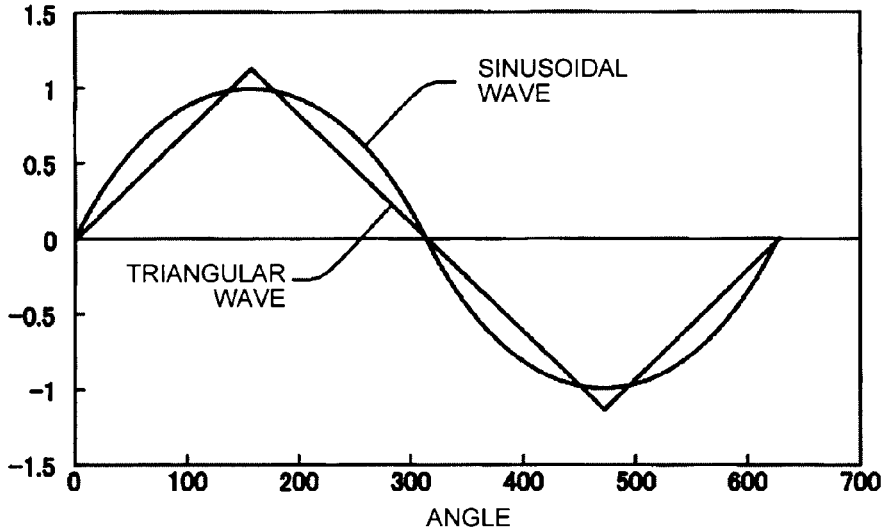
FIG. 34 is a diagram (1) illustrating a difference between a triangular wave and a sinusoidal wave.

FIG. 34 illustrates a sinusoidal wave and a triangular wave that is close to the sinusoidal wave. In FIG. 34, the amplitude of the sinusoidal wave is set to one.

Figure 35:
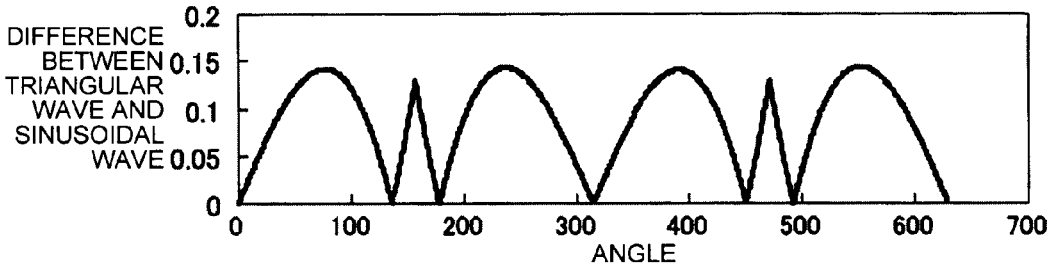
FIG. 35 is a diagram (2) illustrating a difference between the triangular wave and the sinusoidal wave.

FIG. 35 illustrates a difference between values of the sinusoidal wave and the triangular wave that is close to the sinusoidal wave. As can be understood from FIG. 35, in an apex portion of the triangular wave, a difference between the triangular wave and the sinusoidal wave represents a steep variation. In addition, even in a case where the triangular wave is close to the sinusoidal wave, a difference between the light amounts of the triangular wave and the sinusoidal wave is about 15%.

Figure 36:
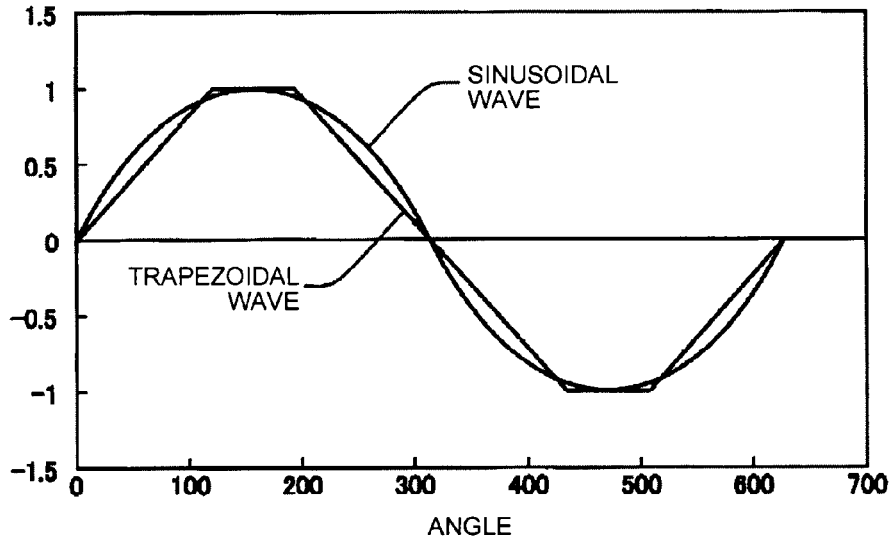
FIG. 36 is a diagram (1) illustrating a difference between a trapezoidal wave and the sinusoidal wave.
Figure 37:
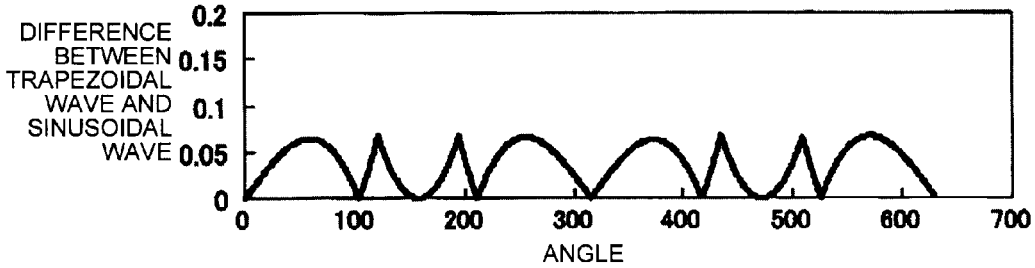
FIG. 37 is a diagram (2) illustrating a difference between the trapezoidal wave and the sinusoidal wave.

FIG. 36 illustrates a sinusoidal wave and a trapezoidal wave that is close to the sinusoidal wave. In addition, FIG. 37 illustrates a difference between the values of the sinusoidal wave and the trapezoidal wave that is close to the sinusoidal wave.

In the case of the trapezoidal wave, although there is a slightly steep variation in the difference between the trapezoidal wave and the sinusoidal wave at the corner portions of the trapezoid, the variation is smaller than that in the case of the triangular wave. In addition, as a whole, the difference between the trapezoidal wave and the sinusoidal wave is about 7% or less, and accordingly, the sinusoidal wave can be simulated with a higher accuracy than that in the case of the triangular wave. In other words, the trapezoidal wave, differently from the triangular wave, has a feature in which the density variation at the peak position is small.

Figure 38:
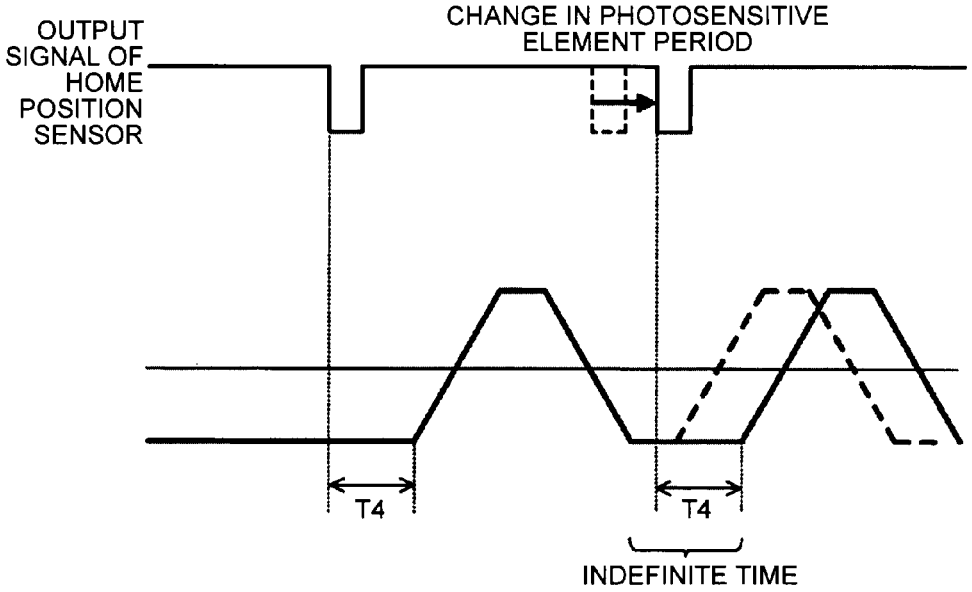
FIG. 38 is a diagram illustrating the advantages of the trapezoidal wave.

In addition, since there no joint in the trapezoidal wave, even in a case where the period of the photosensitive element changes, a correction can be made (see FIG. 38).

Every time when an image is formed, the CPU 3210 acquires a time difference between the home position and the writing start based on the output signal of the home position sensor and the operational timing to start writing that is acquired from the output signal of a synchronization detecting sensor not illustrated in the figure and shifts the phase of the light emitting power correcting signal stored in the flash memory 3211 in accordance with the time difference. Then, the CPU 3210 drives the light source based on the light emitting power correcting signal.

Figure 39:
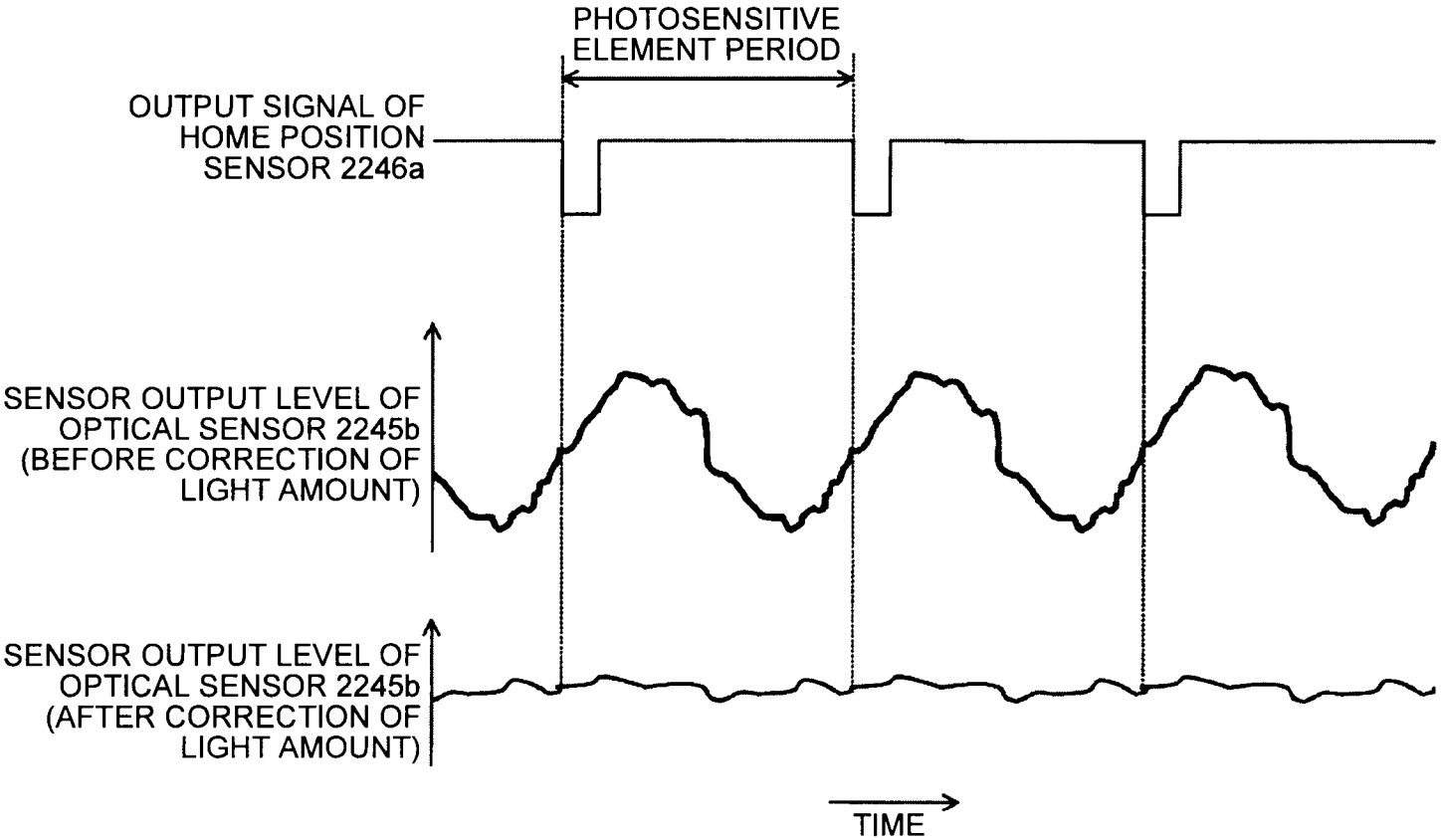
FIG. 39 is a timing diagram (1) illustrating the effect of light emission power correcting.
Figure 40:
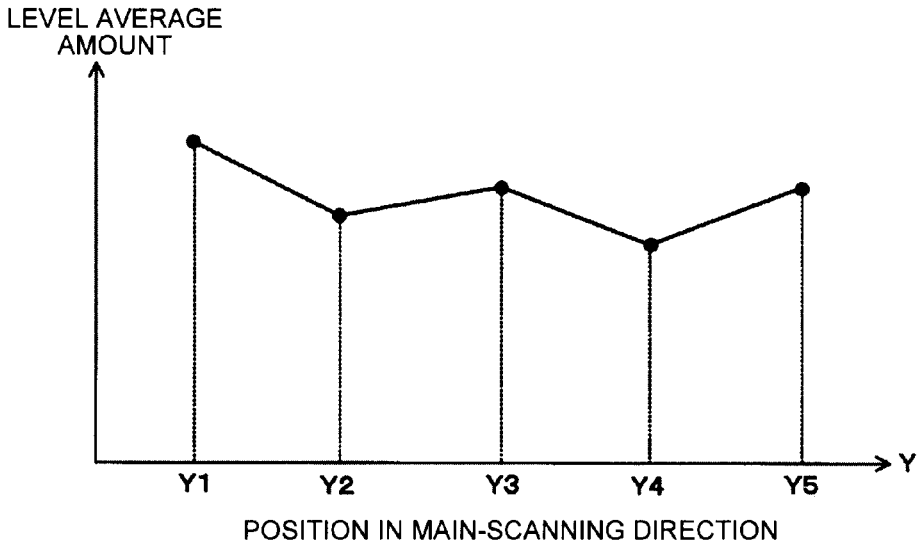
FIG. 40 is a timing diagram (2) illustrating the effect of the light emission power correcting.

FIG. 39 illustrates the sensor output levels of the optical sensor 2245*b* before and after the correction. In addition, FIG. 40 illustrates an average value of levels of the optical sensors after the correction. As above, the density variation in the sub-scanning direction and the density variation in the main-scanning direction could be suppressed.

As described above, the color printer 2000 according to this embodiment includes: the optical scanning device 2010; four photosensitive elements (2030*a*, 2030*b*, 2030*c*, and 2030*d*); four charging units (2032*a*, 2032*b*, 2032*c*, and 2032*d*); four developing rollers (2033*a*, 2033*b*, 2033*c*, and 2033*d*); the transfer belt 2040; the density detector 2245; four home position sensors (2246*a*, 2246*b*, 2246*c*, and 2246*d*), and the like.

The density detector 2245 includes five optical sensors (2245*a*, 2245*b*, 2245*c*, 2245*d*, and 2245*e*).

The optical scanning device 2010 includes four light sources (2200*a*, 2200*b*, 2200*c*, and 2200*d*), four before-deflector optical systems, the polygon mirror 2104, four scanning optical systems, the scanning control device 3022, and the like.

The scanning control device 3022 acquires a light emitting power correcting signal used for suppressing the density variations in the sub-scanning direction and the main-scanning direction based on the output signal of the density detector 2245 and the output signal of the corresponding home position sensor in each station at predetermined operational timing.

Then, the scanning control device 3022 modifies a portion of the light emitting power correcting signal in which the light emitting power is higher than the maximum rated output Pmax such that the light emitting power is at the maximum rated output Pmax or less and modifies a portion thereof in which the light emitting power is lower than the minimum rated output Pmin such that the light emitting power is at the minimum rated output Pmin or more.

In addition, the scanning control device 3022 modifies a portion of the light emitting power correcting signal in which the light emitting power steeply changes so as to alleviate the change in the light emitting power.

Then, when an image is formed, the scanning control device 3022 corrects the driving signal of each light emitting element by using the modified light emitting power correcting signal for each station.

In such a case, density unevenness in the output image in both the sub-scanning direction and the main-scanning direction can be decreased without causing a decrease in the operating life of the light source. As a result, a high-quality image can be formed in a stable manner.

Figure 41:
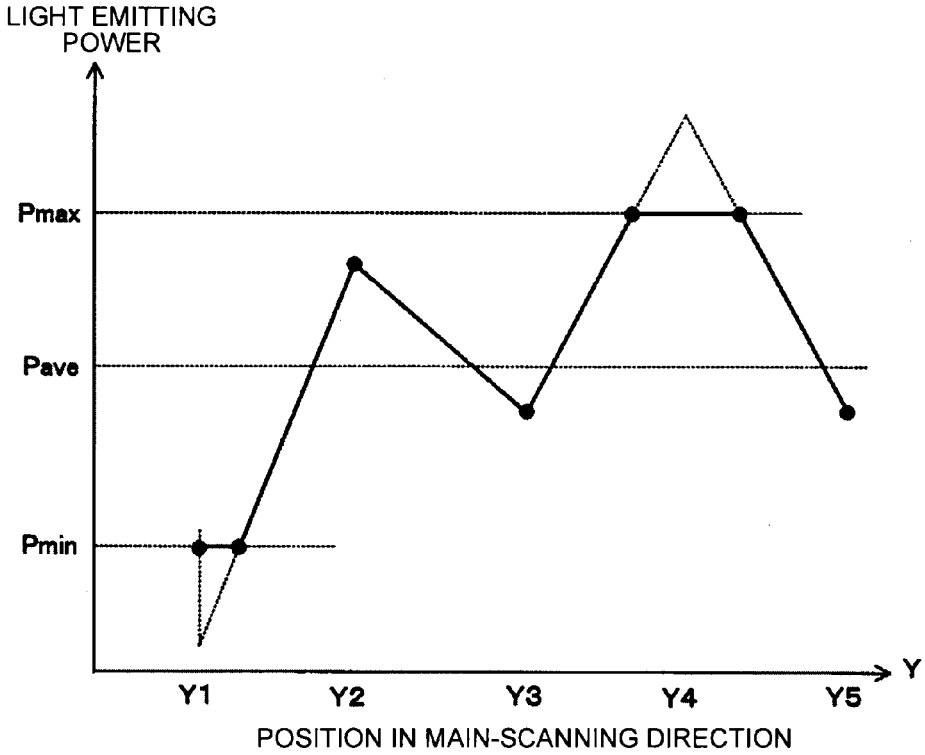
FIG. 41 is a diagram illustrating a modified example of the modified light emission power correcting signal.

In the above-described embodiment, in a case where the influence on the image quality is low even when the change in the light emitting power is large to some degree like a yellow image, as illustrated in FIG. 41, a modification may be made such that the light emitting power is within the range between the maximum rated output Pmax and the minimum rated output Pmin.

In addition, in the above-described embodiment, although a case has been described in which the density detector 2245 includes five optical sensors, the number of the optical sensors is not limited thereto, and, for example, the density detector 2245 may include three optical sensors.

In the above-described embodiment, a part of the process that is performed by the scanning control device 3022 may be configured to be performed by the printer control device 2090.

Furthermore, in the above-described embodiment, at least a part of the process according to the program, which is performed by the CPU 3210, may be configured by hardware, or the entire process may be configured by hardware.

According to the above-described image forming apparatus, an image which has a relatively high image quality can be formed in a stable manner, compared to a conventional image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image according to image information, the image forming apparatus comprising:

a photosensitive element;

an optical scanning device that includes a light source, scans a surface of the photosensitive element in a main-scanning direction using light emitted from the light source, and forms a latent image on the surface of the photosensitive element;

a developer that develops the latent image;

a plurality of density sensors that are arranged at different positions in the main-scanning direction and that are to detect density variations of the image developed by the developer in the main-scanning direction and a sub-scanning direction perpendicular to the main-scanning direction; and a processor configured to generate correction data to correct an output of the light source so as to suppress the density variations based on detection results of the plurality of density sensors, wherein:

the processor is further configured to modify the correction data such that the output after the correction is at a minimum rated output of the light source, or more, at a position at which the output before the correction is lower than the minimum rated output of the light source, in the relation between a position on the surface of the photosensitive element in the main-scanning direction and the output of the light source after the correction, and to modify the correction data such that the output after the correction is at a maximum rated output of the light source, or less, at a position at which the output before the correction is higher than the maximum rated output of the light source.

2. The image forming apparatus according to claim 1, wherein, when there is an extreme value in the relation between the position on the surface of the photosensitive element in the main-scanning direction and the output of the light source after the correction, the processor is configured to additionally modify the correction data such that a change in the output of the light source near an area including the extreme value decreases.

3. The image forming apparatus according to claim 1, wherein, in the relation between the position on the surface of the photosensitive element in the main-scanning direction and the output of the light source after the correction, the processor is configured to additionally modify the correction data such that a change in the output of the light source near an area including both ends in the main-scanning direction decreases.

4. The image forming apparatus according to claim 1, further comprising:

a photosensitive element period detecting sensor to detect a rotation period of the photosensitive element, wherein the processor is configured to acquire a density variation that is caused by the photosensitive element based on output signals of the plurality of density sensors and an output signal of the photosensitive element period detecting sensor.

5. The image forming apparatus according to claim 1, wherein the light source is a vertical cavity surface-emitting laser.

* * * * *